US008526651B2

(12) United States Patent
Lafort et al.

(10) Patent No.: US 8,526,651 B2
(45) Date of Patent: Sep. 3, 2013

(54) RECEIVER MODULE FOR INFLATING A MEMBRANE IN AN EAR DEVICE

(75) Inventors: Adrianus M. Lafort, Delft (NL); Paul Christiaan van Hal, Amsterdam (NL)

(73) Assignee: Sonion Nederland BV, Hoofddorp (NL)

( * ) Notice: Subject to any disclaimer, the term of this patent is extended or adjusted under 35 U.S.C. 154(b) by 115 days.

(21) Appl. No.: 13/011,941

(22) Filed: Jan. 24, 2011

(65) Prior Publication Data

US 2011/0182453 A1 Jul. 28, 2011

Related U.S. Application Data

(60) Provisional application No. 61/297,976, filed on Jan. 25, 2010.

(51) Int. Cl.
*H04R 25/00* (2006.01)

(52) U.S. Cl.
USPC ..... 381/328; 381/322

(58) Field of Classification Search
USPC ..... 381/328, 71.6
See application file for complete search history.

(56) References Cited

U.S. PATENT DOCUMENTS

| | | | | |
|---|---|---|---|---|
| 2,876,767 | A | 3/1959 | Wasserman | |
| 3,602,654 | A | 8/1971 | Victoreen | |
| 4,009,707 | A | 3/1977 | Ward | |
| 4,133,984 | A | 1/1979 | Akiyama | |
| 4,539,440 | A | 9/1985 | Sciarra | |
| 4,834,211 | A * | 5/1989 | Bibby et al. | 181/135 |
| 4,852,177 | A | 7/1989 | Ambrose | |
| 5,063,946 | A | 11/1991 | Wada | |
| 5,333,622 | A | 8/1994 | Casali et al. | |
| 5,338,287 | A | 8/1994 | Miller et al. | |
| 5,500,902 | A | 3/1996 | Stockham et al. | |
| 6,094,494 | A | 7/2000 | Haroldson | |
| 6,339,648 | B1 | 1/2002 | McIntosh et al. | |
| 6,354,990 | B1 | 3/2002 | Juneau et al. | |

(Continued)

FOREIGN PATENT DOCUMENTS

| | | | |
|---|---|---|---|
| CA | 2305241 | A1 | 2/2000 |
| DE | 2825233 | A1 | 1/1979 |

(Continued)

OTHER PUBLICATIONS

Compton; "Notes on the Diaphone"; *The Organ*; vol. 3; No. 9; pp. 42-47; 1923.

(Continued)

*Primary Examiner* — Curtis Kuntz
*Assistant Examiner* — David J Ho
(74) *Attorney, Agent, or Firm* — Nixon Peabody LLP

(57) ABSTRACT

A receiver module configured to be seated within an ear canal and optimized for simultaneously inflating an inflatable membrane while generating acoustic waves transmitted to a user. The inflatable membrane can be used to secure the receiver module within the bony portion of the ear canal of the user. A multi-layer valve system and method of assembly are disclosed for a valve system to harvest static pressure from acoustic waves generated within the receiver and direct the increased pressure toward the inflatable membrane to inflate the membrane. The multi-layer valve system can be used to prevent a back flow of air and thereby maintain a static pressure differential between ambient air drawn in through an air ingress port and air forced into the inflatable membrane through an air egress port.

19 Claims, 23 Drawing Sheets

(56) References Cited

U.S. PATENT DOCUMENTS

| | | | | |
|---|---|---|---|---|
| 6,438,244 | B1 | 8/2002 | Juneau et al. | |
| D478,062 | S | 8/2003 | Stephens | |
| 6,671,381 | B1 | 12/2003 | Lux-Wellenhof | |
| 6,901,288 | B2 | 5/2005 | Janke et al. | |
| 7,227,968 | B2 | 6/2007 | van Halteren et al. | |
| 7,292,704 | B2 | 11/2007 | Lederer | |
| 7,425,196 | B2 | 9/2008 | Jorgensen et al. | |
| 8,391,534 | B2 * | 3/2013 | Ambrose et al. | 381/380 |
| 2001/0043708 | A1 | 11/2001 | Brimhall | |
| 2002/0076057 | A1 | 6/2002 | Voix | |
| 2002/0114479 | A1 | 8/2002 | McIntoch et al. | |
| 2002/0136421 | A1 | 9/2002 | Topholm | |
| 2002/0196958 | A1 | 12/2002 | Halteren et al. | |
| 2004/0215053 | A1 | 10/2004 | Jorgensen et al. | |
| 2006/0245951 | A1 * | 11/2006 | Ball, Jr. | 417/413.3 |
| 2007/0116319 | A1 | 5/2007 | Hagberg | |
| 2007/0270988 | A1 | 11/2007 | Goldstein et al. | |
| 2008/0015463 | A1 | 1/2008 | Goldstein | |
| 2008/0031475 | A1 | 2/2008 | Goldstein | |
| 2008/0037797 | A1 | 2/2008 | Goldstein et al. | |
| 2008/0137873 | A1 | 6/2008 | Goldstein | |
| 2008/0144842 | A1 | 6/2008 | Goldstein et al. | |
| 2008/0181419 | A1 | 7/2008 | Goldstein et al. | |
| 2008/0181442 | A1 | 7/2008 | Goldstein et al. | |
| 2008/0187163 | A1 | 8/2008 | Goldstein et al. | |
| 2008/0212787 | A1 | 9/2008 | Goldstein et al. | |
| 2008/0219486 | A1 | 9/2008 | Goldstein et al. | |
| 2008/0240458 | A1 | 10/2008 | Goldstein | |
| 2008/0253583 | A1 | 10/2008 | Goldstein et al. | |
| 2008/0299339 | A1 | 12/2008 | Keady | |
| 2008/0311324 | A1 | 12/2008 | Keady | |
| 2009/0007596 | A1 | 1/2009 | Goldstein et al. | |
| 2009/0010442 | A1 | 1/2009 | Usher et al. | |
| 2009/0012420 | A1 | 1/2009 | Keller | |
| 2009/0014014 | A1 | 1/2009 | Roos et al. | |
| 2009/0022294 | A1 | 1/2009 | Goldstein et al. | |
| 2009/0022353 | A1 | 1/2009 | Goldstein et al. | |
| 2009/0028356 | A1 * | 1/2009 | Ambrose et al. | 381/71.6 |
| 2009/0034765 | A1 | 2/2009 | Boillot et al. | |
| 2009/0067661 | A1 | 3/2009 | Keady et al. | |
| 2009/0071486 | A1 | 3/2009 | Perez et al. | |
| 2009/0071487 | A1 | 3/2009 | Keady | |
| 2009/0130423 | A1 | 5/2009 | Keady | |
| 2009/0147966 | A1 | 6/2009 | McIntosh et al. | |
| 2009/0155518 | A1 | 6/2009 | Keady | |
| 2009/0192407 | A1 | 7/2009 | Keady et al. | |
| 2009/0232684 | A1 | 9/2009 | Hirata et al. | |
| 2011/0311069 | A1 * | 12/2011 | Ambrose et al. | 381/71.6 |

FOREIGN PATENT DOCUMENTS

| | | | |
|---|---|---|---|
| EP | 0383483 | A1 | 8/1990 |
| EP | 0755168 | A2 | 1/1997 |
| EP | 0855847 | A2 | 7/1998 |
| EP | 1272003 | A1 | 1/2003 |
| GB | 2323295 | A | 9/1998 |
| JP | 52019905 | A | 2/1977 |
| JP | 53147526 | A | 12/1978 |
| JP | 55047713 | A | 4/1980 |
| JP | 61238198 | A | 10/1986 |
| JP | 01101794 | A | 4/1989 |
| JP | 6335473 | A | 12/1994 |
| KR | 1990-0013806 | A | 9/1990 |
| WO | 86/01399 | | 3/1986 |
| WO | 99/31934 | | 6/1999 |
| WO | 99/31935 | | 6/1999 |
| WO | 00/08895 | A2 | 2/2000 |
| WO | 01/00267 | A1 | 1/2001 |
| WO | 02/067626 | A2 | 8/2002 |
| WO | 02/082788 | A1 | 10/2002 |
| WO | 03/005765 | A2 | 1/2003 |
| WO | 2009/015210 | A2 | 1/2009 |
| WO | 2009/055347 | A2 | 4/2009 |

OTHER PUBLICATIONS

Data Sheet RoHS 2002/95/EC receiver 44A030; 3 pages; Aug. 7, 2009.

Luo et al.; "Sensors and Actuators A 122"; pp. 131-140; 2005.

Mays et al.; "Synthesis and Structure—Property Relationships for Regular Multigraft Copolymers"; *Macromolecular Symposia*; 215; pp. 111-126; 2004.

O'Brien et al.; "Evaluation of Acoustic Propagation Paths into the Human Head"; *New Directions for Improving Audio Effectiveness*; pp. 15-1-15-24; 2005.

"Sound Fit™ In—Canal Sound Delivery and Custom Fit Sleeve for Bluetooth™ Headsets", http://ctiait.ctia.org/eTechw2009public/index.cfm?fuseaction=main.viewEntry&productID=692&start=1&subCat=5&scoreStatus=all&ct=1[Mar. 30, 2009 12:41:13PM] E-Tech Awards 2009 Public Site 2009.

Staudinger et al.; "Mechanical Properties and Hysteresis Behavior of Multigraft Copolymers"; *Macromolecular Symposia*; 233, pp. 42-50; 2006.

Tiku; "When his bank cut the cord, Kevin Semcken faced a tough choice; Stick to his own big plans? Or listen to his board and play it safe?"; Inc.; pp. 58-61; Jul./Aug. 2009.

Weidisch et al.; "Tetrafunctional Multigraft Copolymers as Novel Thermoplastic Elastomers"; *Macromolecules*; 34, pp. 6333-6337; 2001.

Zhu et al.; "Morphology and Tensile Properties of Multigraft Copolymers With Regularly Spaced Tri-, Tetra-, and Hexafunctional Junction Points"; *Macromolecules*; 39; pp. 4428-4436; 2006.

Zwislocki; "Factors Determining the Sound Attenuation Produced by Earphone Sockets"; *The Journal of the Acoustical Society of America*; vol. 1; No. 1; pp. 146-154; 1955.

Zwislocki, "In Search of the Bone-Conduction Threshold in a Free Sound Field," *The Journal of the Acoustical Society of America*; vol. 29; No. 7; pp. 795-804; 1957.

International Search Report for PCT/US2010/034237, issued Dec. 23, 2010.

* cited by examiner

| | |
|---|---|
| NOMINAL VOLTAGE: | 1 = V |
| RATED CAPACITY: | 90 mAh AT 3000 OHM TO 1.1V AT 21°C (70°F) |
| NOMINAL INTERNAL IMPEDANCE: | 14 ohm @ 12 Mz |
| AVERAGE WEIGHT: | 0.3 gm |
| VOLUME: | 0.06 $cm^3$ |
| TERMINALS: | FLAT |
| OPERATING TEMPERATURE RANGE: | 0°C TO 50°C (32°F TO 122°F) |
| ANST. | 7005 ZO |
| IEC. | PR70 |

RECEIVER MODULE FOR INFLATING A MEMBRANE IN AN EAR DEVICE

CROSS REFERENCE TO RELATED APPLICATIONS

This application claims priority to U.S. Provisional Application No. 61/297,976, filed Jan. 25, 2010, the contents of which is incorporated by reference in its entirety.

FIELD OF THE INVENTION

The invention pertains to receiver modules for hearing aids and listening devices, and more particularly, to receiver modules configured to both emanate sound waves and inflate an expansible membrane suitable for mounting the hearing or listening device within the bony area of the ear canal.

BACKGROUND OF THE INVENTION

Hearing aids are devices used to detect, process, and amplify sound, and then transmit the detected sound to a user. Hearing aids therefore include electrical components, including a processor for analyzing and amplifying detected signals, a power source, a microphone, and a receiver. The microphone detects sound waves and creates electrical signals indicative of the detected sound waves. The electrical signals are typically processed within a processor where desirable aspects of the detected signals may be amplified, and the processed signals are then passed to the receiver. The receiver generally includes a movable membrane for generating pressure waves (i.e. sound waves) that are directed toward the ear drum of the user of the hearing aid.

Hearing aids have been developed that can be worn in more than one configuration. Some hearing aids include electrical components to be worn behind the ear, and components interior to the ear canal, with fluid connections between the interior components and the components worn behind the ear. Receiver In Canal (RIC) hearing aids are hearing aids where the electrical components required to detect, analyze, amplify, and transmit sound waves to the user are fully contained within the ear canal. For example, U.S. Pat. No. 7,227,968 discloses a device adapted for fitting an acoustic receiver within a bony portion of the ear canal using an expansible balloon-like device to seat the acoustic receiver within the bony portion of the ear canal and thereby enhance the transmission of sound waves and enhance the comfort experienced by a user.

Hearing aids today are typically assembled in one piece such that all the components—are encapsulated in a common plastic shell. The hearing aid is positioned at a relatively large distance from the eardrum, usually in front of the bony area of the ear canal. The reason for this is that the plastic material forming the shell encapsulating the above-mentioned components is hard, which makes it difficult to position such a hearing aid in the bony area of the ear canal without introducing pain to the user of the hearing aid. Another disadvantages of one-piece hearing aids include the large distance between the receiver output and the eardrum to be excited, acoustic feedback from the receiver to the microphone, vibrations of the receiver (which is transmitted to the ear canal and can be unpleasant for the user), a somewhat complicated and painful mounting of the hearing aid.

SUMMARY OF THE INVENTION

The present disclosure provides a receiver for use in a hearing aid, or other receiver in canal (RIC) transducer, adapted to both generate acoustic waves and pressurize an inflatable membrane. The receiver presented is optimized for the pressurization of the inflatable membrane by a valve subassembly connected to the exterior of the receiver housing. The valve assembly (or valve system) provides for fluid communication between an interior volume of the inflatable membrane and a portion of the receiver. In particular, in an implementation where the receiver has both a back volume and a front volume, the valve subassembly may provide for fluid communication between the back volume and the interior volume of the inflatable membrane.

A method of constructing the receiver's valve subassembly is provided where the valve assembly is created from multiple thin layers having holes or channels. The multiple thin layers, when attached to one another and to the exterior housing of the receiver, create small channels defining both an ingress port and an egress port. The receiver's valve subassembly can be further optimized to prevent backflow of pressurized fluid within the inflatable membrane back to the receiver, or back to an ingress port from which ambient air is drawn into the valve system.

Aspects of the present disclosure provide a receiver module adapted for being positioned within an ear canal. The receiver module includes a housing having a sound port for transmitting acoustic waves within the ear canal and an inflation port. The receiver module also includes a diaphragm within the housing. The diaphragm can be driven to create: (i) the acoustic waves in response to a first electrical input signal to the receiver module and (ii) a membrane-inflation pressure adjacent to the inflation port in response to a second electrical input signal to the receiver module. The receiver module also includes a front volume within the housing and in direct communication with the sound port. The front volume allows the acoustic waves to be transmitted through the sound port. The receiver module also includes a back volume within the housing on an opposing side of the diaphragm relative to the front volume. The back volume can be in direct communication with the inflation port. The receiver module also includes a valve system coupled to the housing directly adjacent to the inflation port. The valve system can include a plurality of layers to provide a flat configuration to the valve system. At least one of the plurality of layers can define an egress port. In response to the membrane-inflation pressure created by the diaphragm, the valve system can cause the inflation of an external inflatable membrane located within the ear canal by expelling air through the egress port.

Aspects of the present disclosure also provide a method of operating a receiver module to inflate an inflatable membrane positioned within an ear canal of a user. The receiver module can include a valve system that includes a plurality of layers mechanically coupled to a housing of the receiver. The valve system can have a flat profile with an overall thickness that is less than the width dimension of the housing. The plurality of layers of the valve system can have an egress port coupled to the inflatable membrane. The method of operating the receiver module includes drawing air in through an ingress port. The ingress port can be defined by at least one of the plurality of layers of the valve system of the receiver module. The method also includes generating, by use of a diaphragm, pressure within the back volume of the receiver module. The method can also include forcing air displaced by the generated pressure into the valve system and expelling the displaced air through the egress port. The plurality of layers of the valve system can be configured to substantially maintain a static pressure differential between the back volume and the egress port so as to optimize the receiver module for inflating the inflatable membrane.

The foregoing and additional aspects and implementations of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

DETAILED DESCRIPTION

Figure 1:
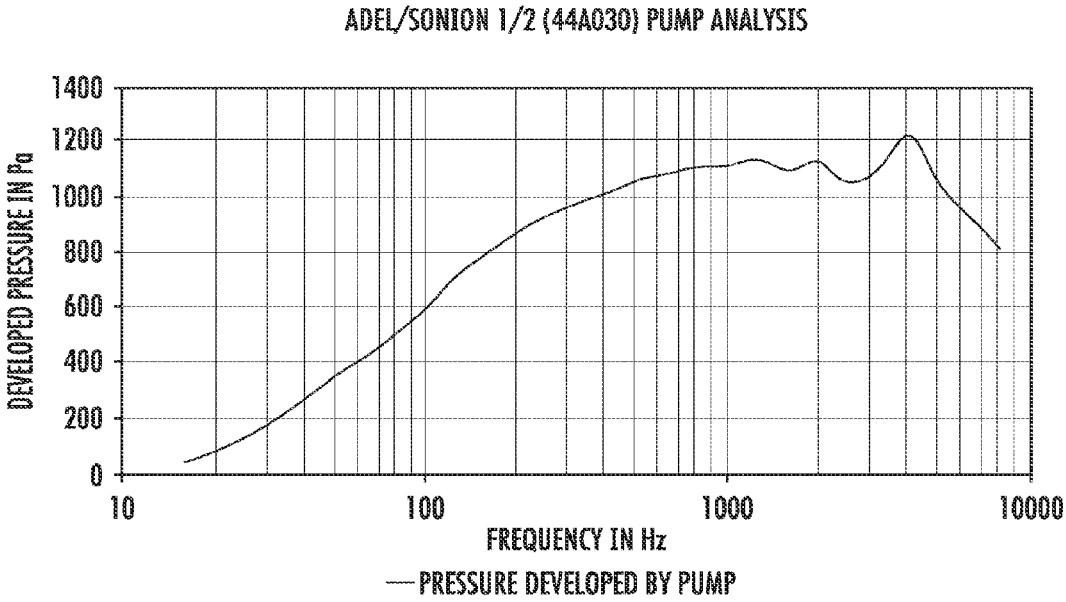
FIG. 1 is a line graph illustrating pump pressure developed by Sonion 44A030 transducer along a frequency range.
Figure 2:
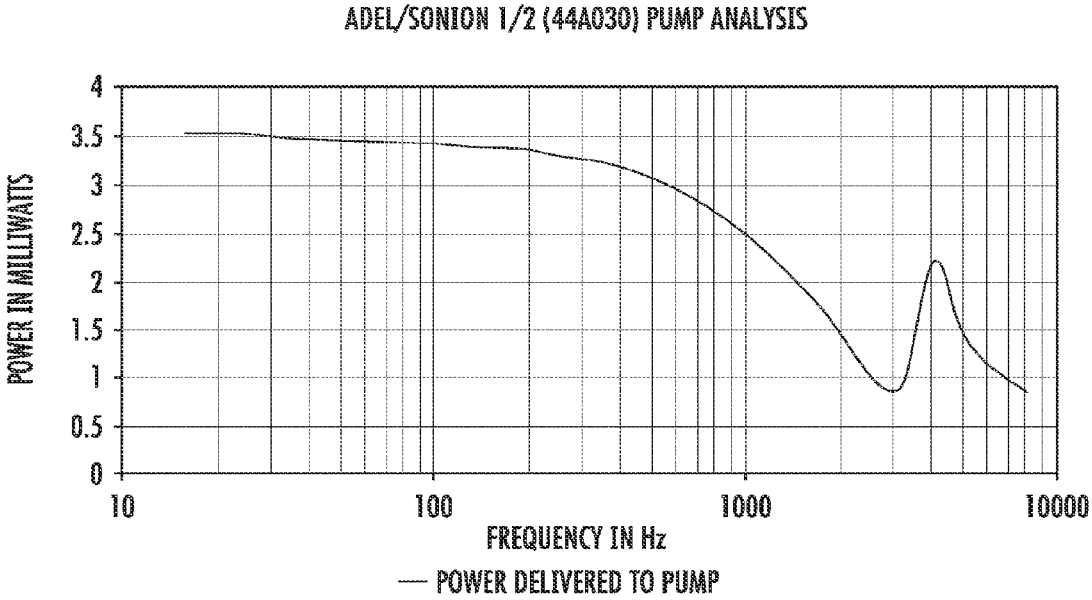
FIG. 2 is a line graph illustrating power required by the Sonion 44A030 transducer along the same frequency range as that of FIG. 1.
Figure 3:
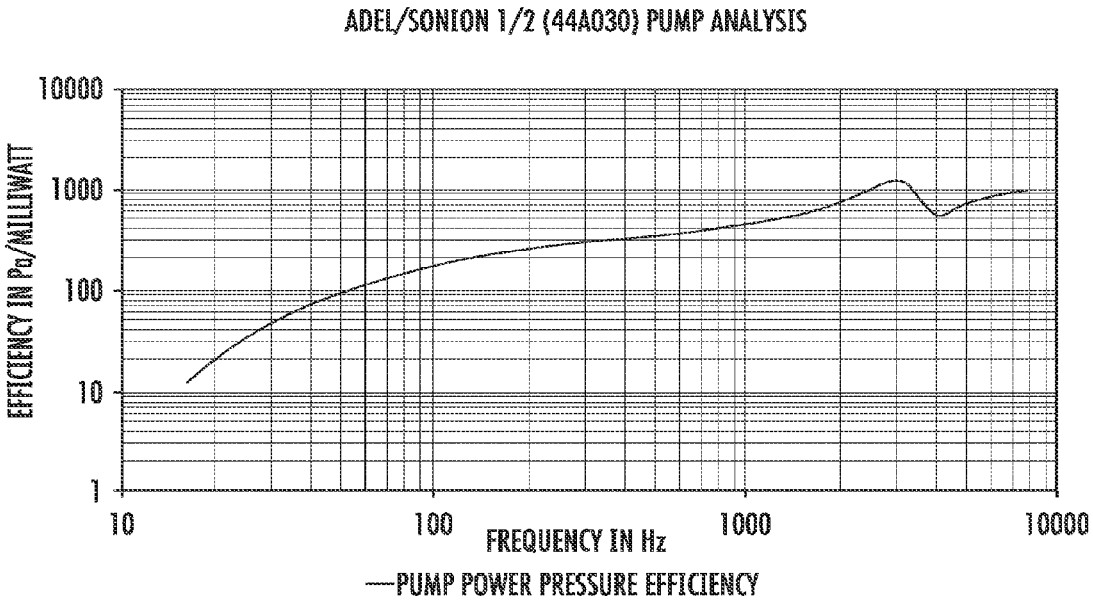
FIG. 3 is a line graph illustrating the efficiency of the Sonion 44A030 transducer along the same frequency range as that of FIG. 1.

FIGS. 1-20 illustrate some of the functional aspects of using one type of expansible balloon-like device (e.g., a membrane or "bubble") to assist in seating the acoustic receiver in the bony portion of the ear. FIGS. 21-29 will then describe the receiver's valve subassembly that is useful in assisting the receiver in inflating the expansible balloon-like device Pumping Efficiency and Power Consumption: FIGS. 1-3

U.S. Provisional Patent Application Ser. No. 61/253,843, filed Oct. 21, 2010, which is incorporated herein by reference in its entirety, describes numerous embodiments of a device, the Ambrose Diaphonic Ear Lens or ADEL, in which a diaphonic valve is used to harvest sound pressure from the operation of a balanced armature audio transducer, for the purpose of inflating a bubble in the ear.

Experimental study of working embodiments of the ADEL have allowed the evaluation of bubble inflation pressure versus transducer frequency and the power efficiency of bubble inflation versus transducer frequency. For example, these measurements were performed on an ADEL device pumped with the pressure generated by a diaphonic valve fitted to the back volume of one half of a Sonion dual transducer (44A030). FIG. 1 shows the pressure developed by the ADEL pump as a function of frequency. This graph shows that, for this particular example of the ADEL device, the highest pressure can be generated at about 4000 Hz.

However, the condition of peak pressure generation, as shown in FIG. 1, is not necessarily the optimal frequency for ADEL operation because the transducer draws different amounts of power when it is operated at different frequencies.

FIG. 2 shows the power required to drive this particular ADEL device as a function of frequency.

While the ADEL can generate the highest pressure at about 4000 Hz (FIG. 1), FIG. 2 shows that this frequency corresponds to a local maximum in power requirement. It is desirable to operate the ADEL at a frequency where the pumping is most energy efficient so as to make the optimum use of the limited power available in a battery driven application such as a hearing aid or an MP3 player. This frequency is found at the maximum of the ratio of pressure generated (FIG. 1) to power required (FIG. 2). A plot of this ratio vs. frequency is shown in FIG. 3.

FIG. 3 shows that operating this particular ADEL device at about 3000 Hz gives best energy efficiency: Pascals of pressure generated per milliWatt of power consumed. This conclusion is only useful provided that, at its most energy efficient frequency, the ADEL can actually generate a high enough pressure to fulfill its intended application. When the application is sealing an ADEL bubble in a listener's ear, a pressure of 1 kPa is more than adequate, and thus 3000 Hz is found to be a good operational frequency for this ADEL device.

By comparison, FIG. 3 shows that high energy efficiency is also achieved at the highest frequencies measured: 8000 Hz. The trend of the data also suggests that it may be possible to continue to increase pumping efficiency by going to even higher frequencies, or at least that a similarly high efficiency might be maintained at even higher frequencies. This observation raises the attractive possibility of an ADEL device that inflates a balloon in the listener's ear by operating at a very high frequency, which is beyond the audible range. However, FIG. 1 indicates that this may not be practical, at least for the particular embodiment evaluated here. The pressure generated by the ADEL drops off at high frequencies, and the trend indicates that at frequencies above the audible range, that the device may generate insufficient pressure for the application. Thus, this particular ADEL should be operated at 3000 Hz to provide the combination of performance and efficiency.

Finally, FIGS. 1 and 3 show that workable pressures and reasonable power efficiencies are achieved over a very broad range of frequencies, from less than 100 Hz to as high as 8000 Hz with this particular transducer. Other transducers may have even broader usable ranges. This suggests that one can produce effective ADEL pumping using a wide range of sound including the environmental sounds picked up by a hearing aid, conversation, music etc. Tests on a prototype ADEL hearing aid device showed that normal conversation or recorded music played at normal levels produced enough pressure to inflate an ADEL bubble and produce an effective ear seal.

Figure 4:
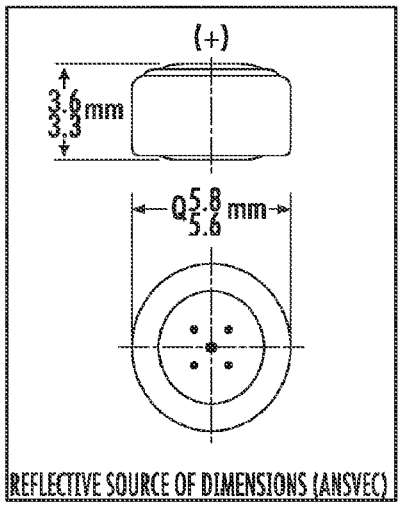
FIG. 4 is a reproduction of the operating parameters of a Duracell Zinc Air Battery 10, including an operation voltage curve.
Figure 4:
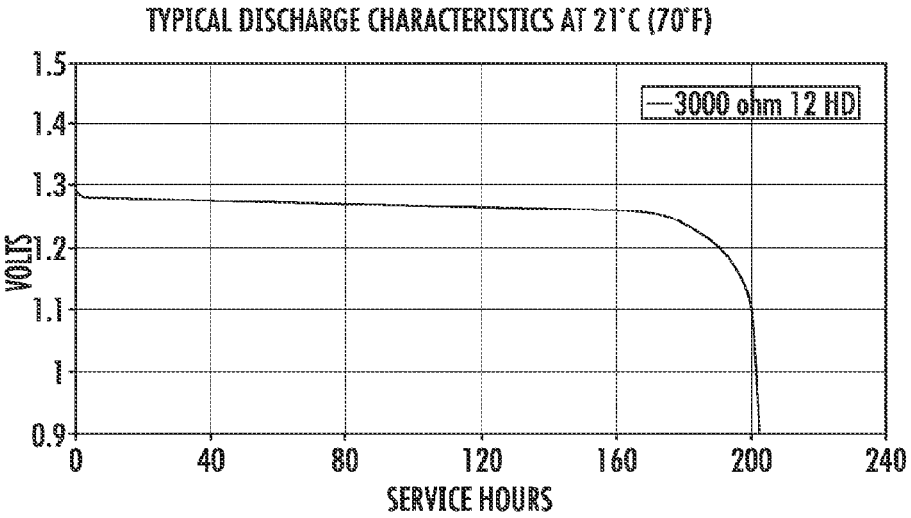

Battery Life Considerations: FIG. 4

For an ADEL device, which inflates a bubble in the ear using sound generated by the device itself, it is important that the power required to inflate the bubble and to keep it inflated is a small enough percentage of the available battery power so as not to adversely impact the device performance. For the hearing aid application, the ADEL bubble inflation and bubble pressure maintenance should not consume any more than 5% of the available battery energy.

One example is the use of a Zinc Air Battery Powering an ADEL on a Behind the Ear (BTE), Receiver In Canal (RIC) Hearing Aid. The data sheet, shown in FIG. 4, is for the size hearing aid battery typically used in small BTE style RIC type products (5.7 mm dia×3.5 mm thick). It is a No. 10 Zinc Air Battery as manufactured by Duracell.

The "Typical Discharge Curve" shown in FIG. 4 assumes a load impedance of 3000 ohms applied for twelve hour periods, with 12 hour rest periods in between. This suggests a hearing aid user would use the device for 12 hours per day. The graph shows a battery voltage of about 1.3 volts as being maintained for about 180 hours. The end point voltage appears to be 0.9 volts after a little more than 200 hours. This would imply that the power being dissipated for 180 hours is 1.3×1.3/3000 equal to 0.00056 Watts or 0.56 milliwatts. This further implies that the energy being expended from the battery over a 180 hour time period is 0.00056 Watts×180 Hours or 0.101 Watt Hours.

Applying the guideline that the ADEL inflation pump can at most consume 5% of the available battery energy, this would be about 0.005 Watt Hours or 5 millwatt hours. If the battery powers the hearing aid for 12 hours a day and provides such service for 180 hours, this would be approximately 15 days. Thus, the ADEL can consume about 0.3 milliwatt hours/day for bubble inflation and bubble pressure maintenance. Based on measurements made on one prototype ADEL pump (ADEL device pumped with the pressure generated by a diaphonic valve fitted to the back volume of one half of a Sonion dual transducer 44A030, as discussed above) operating at 3.15 kHz (the most energy efficient condition, as discussed in connection with FIGS. 1-3), capable of generating a bit more than 1 kPa with a power consumption of 0.9 milliwatts, this would indicate a maximum inflating time is about ⅓ of an hour or 20 minutes/day.

Twenty minutes of pumping per 12 hour day (what is allowed by a limit of 5% of battery energy) is far in excess of the amount of pumping required to inflate and maintain inflation of an ADEL bubble provided that the bubble is a statically inflated (low permeability) bubble, and the diaphonic valve is prevented from leaking with the addition of a check valve. ADEL bubble air loss is discussed in below.

Air Loss of a Statically Inflated Bubbles and Bubble Material Options

The following calculations determine the rate of air loss from a statically inflated ADEL bubble. This particular example is for a bubble composed of Kraton® polymer (a block copolymer of polystyrene and a polydiene, or a hydrogenated version thereof). These calculations are also a good approximation for the behavior of expanded polytetrafluroethylene (ePTFE) bubbles that have been coated with Kraton®, as well as for bubbles composed of polyurethane. In the case of an ePTFE bubble coated with Kraton®, the Kraton® is much more air permeable than the PTFE scaffolding of the ePTFE. It is assumed that the gas is leaking out though a membrane of Kraton equal to the total bubble wall thickness (including Kraton and ePTFE). This provides an over estimate of the air loss, and thus is a worst case scenario.

Characteristics of the bubble used for the estimate assume 1 cm diameter, spherical shape, 0.1 mil=0.00025 cm wall thickness. Calculations where done for two internal pressures (relative to outside atmospheric pressure) 100 Pa and 1 kPa.

In general for transport of a gas through a polymer: J=P (dp/dx), where J is the flux of gas through the polymer membrane in ($cm^3$ of gas)/(($cm^2$ of membrane area)(second)), P is the gas permeably of the membrane and (dp/dx) is the driving pressure gradient across the membrane, the x coordinate being distance in the membrane thickness direction.

The permeability of Kraton® to air is: $1\times10^{-9}$ (($cm^3$ of air)(cm of membrane thickness))/((cm2 membrane area)(second)(pressure in cm of Hg)) [Reference: K. S. Laverdure "Transport Phenomena within Block Copolymers: The Effect of Morphology and Grain Structure" Ph.D. Dissertation, Chemical Engineering, University of Massachusetts at Amherst, 2001.]

The driving pressure gradient $(dp/dx)\approx(\Delta p/\Delta x)$ is 295 (cm Hg)/(cm thickness) if the interior bubble pressurization is 100 Pa, and it is 2950 (cm Hg)/(cm thickness) if the interior bubble pressurization is 1 kPa.

The resulting flux of air through the membrane, J, is $3\times10^{-7}$ ($cm^3$ of air)/($cm^2$ of membrane)s when the interior bubble pressurization is 100 Pa, and J is $3\times10^{-6}$ ($cm^3$ of air)/($cm^2$ of membrane)s when the interior bubble pressurization is 1 kPa. Based on the volume and surface area of a 1 cm diameter bubble, these calculations indicate that with a 1 00Pa internal pressure, the bubble will loose 2% of its gas in 12 hours and that at 1 kPa it will loose 20% of its gas in 12 hours, this time period being the assumed normal length of daily wear (see discussion related to FIG. 4). This calculation is an estimate that assumes the air pressure inside the bubble remains constant throughout the process. This is a good approximation for the 2% loss found for 100 Pa, and this calculation is quite accurate. The estimate is poorer for the 20% loss at 1 kPa since such a significant loss will obviously reduce the bubble pressure and thus the driving force for further air loss. Thus the 20% at 1 kPa is a worst case estimate. The calculation is sensitive to the thickness of the bubble wall. A doubling the wall thickness to 0.2 mil will cut the gas loss rate in half to 1% for 100 Pa, for instance. Increasing the wall thickness to 1 mil will cut all calculated loss percentages by a factor of 10.

The calculations are most accurate for a case in which the diaphonic valve is used to periodically top off the pressure in the bubble. In this case, to maintain a pressure of 1 kPa in the bubble over 12 hours by intermittent use of the diaphonic valve, the ADEL would need to make up 20% of the bubble volume in that 12 hour period. This is a very small amount of pumping and would fall far below the 20 minutes per day of pumping necessary to stay below 5% of hearing aid batter use.

Experimental investigation of ADEL bubbles has shown that they can be inflated and remain inflated, with no noticeable loss of pressure for at least a day and in some cases up to a week.

Figure 5:
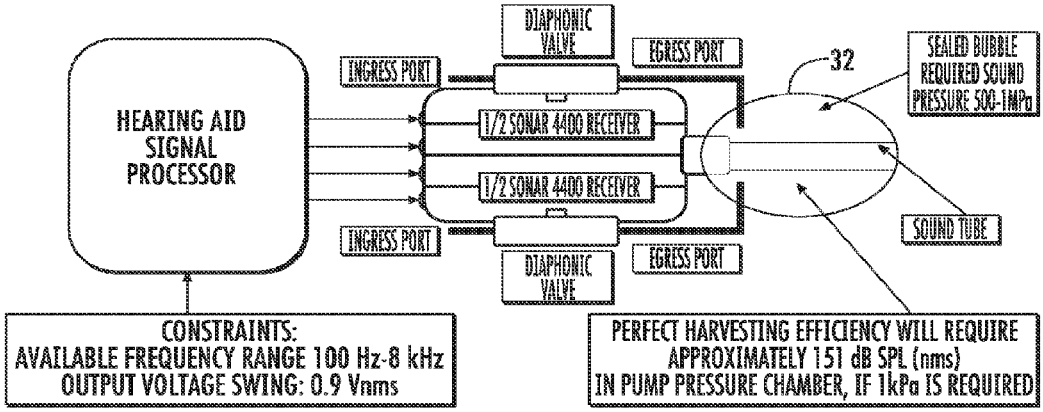
FIG. 5 is a schematic of an embodiment of a two transducer device in accordance with the present invention.
Figure 6:
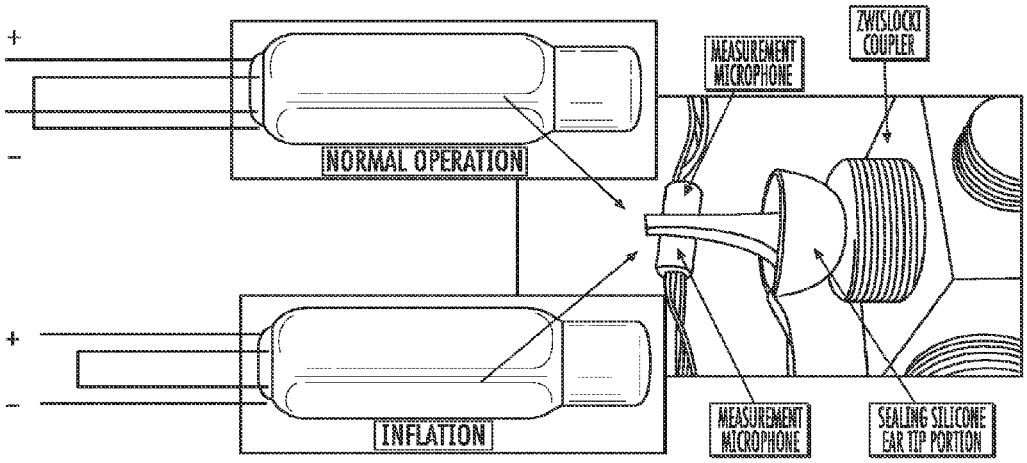
FIG. 6 is a photographic depiction of a Sonion 44A030 dual transducer wired so that the polarity of one of the transducers can be switched relative to the other.
Figure 7:
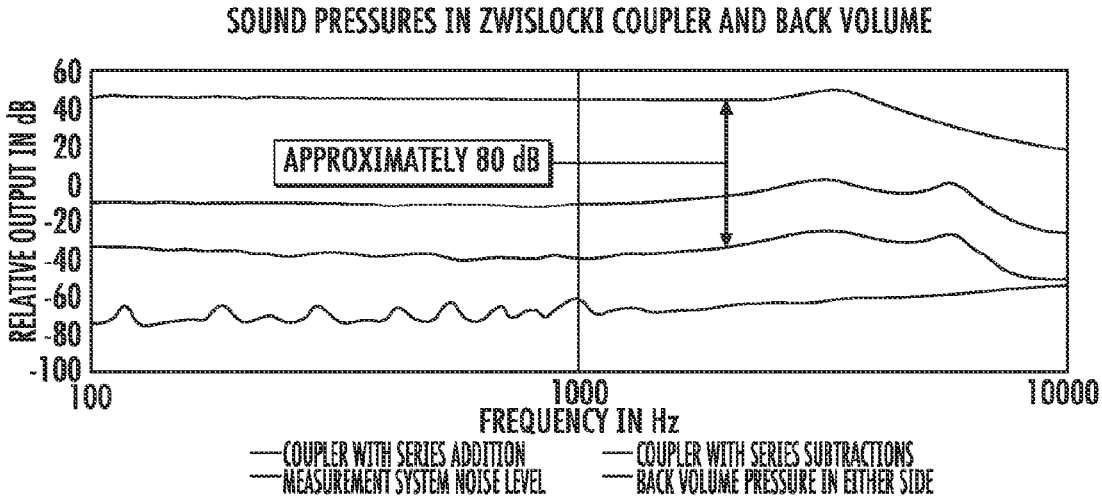
FIG. 7 is a graph showing the difference in sound pressure level (SPL) measured in a Zwislocki Coupler, which approximates the signal at the user's ear drum, corresponding to two transducers running 180 degrees out of phase in accordance with an embodiment of the present invention.

Active Noise Cancellation to Quiet the Inflation of the Bubble: FIGS. 5-7

In the previous sections, it was shown that a particular ADEL embodiment built with a Sonion 44A030 dual transducer has its best energy efficiency, for pumping air to inflate bubbles in the ear, at a frequency of about 3 kHz. At this operation frequency, the device can inflate and maintain inflation of a bubble in the ear over 12 hour periods, using less than 5% of the available battery power in a typical hearing aid. However, doing this requires initial and perhaps intermittent use of an inflation tone of about 3 kHz at a considerable amplitude (loudness). This tone may be unpleasant to the listener. Other ADEL embodiments, based on other transducers and other diaphonic valve configurations, may have their most energy efficient pumping at somewhat different frequencies. However, all such devices will have a frequency or range of frequencies in which pumping is most efficient, and this tone will often have the potential to be unpleasant to the listener when played with sufficient amplitude (power) to affect bubble inflation.

To mitigate this problem of an unpleasant inflation tone, two transducers are used in an ADEL device. The acoustical output of these two transducers, during the inflation of the ADEL bubble, is partially or completely out of phase so as to produce a noise cancellation (reduction in amplitude) and/or a shift in the audible frequency, so as to make the inflation process less objectionable to the listener.

One example of this invention is an ADEL device built with a balanced armature transducer (e.g. the type disclosed previously in U.S. Provisional Patent Application Ser. No. 61/253,843, filed Oct. 21, 2009, to Ambrose et al., incorporated herein by reference) paired with a second transducer. The ADEL generates pressure from sound pressure oscillations in the back volume of one of the transducers, and this pressure is used to inflate the bubble (closed or donut shaped) in the listener's ear. The other transducer is used to produce a sound output which is matched (to the degree possible) in frequency and amplitude and is 180 degrees out of phase with the output of the transducer with the ADEL. This arrangement quiets the device during ADEL bubble inflation.

For this device, during normal hearing aid (or other audio) operation, one of the two transducers (either the one with the ADEL or the one without the ADEL) can be turned off and the other transducer can provide the audio material to the listener. This requires a switching scheme, which may be mechanical or electronic, in which one transducer is turned on and off. It is also possible to run both transducers in phase, and thus reinforcing each other's signal, during normal hearing aid operation. This requires a switching scheme, which may be mechanical or electronic, in which one transducer has its electrical input reversed (180 degrees out of phase for bubble inflation) and then switched back (in phase for normal listening).

Another example is a two transducer device, in which the audio output of the two transducers may be run out of phase during bubble inflation to quiet the device, but in which both transducers are incorporated into ADEL pumps working from their back volumes. With two ADELs working to inflate the bubble, this device will inflate the bubble more quickly. It is desirable to the application for the bubble inflation process to be quick (less than 20 seconds and preferably less than 10 seconds), as well as quiet.

An ADEL device providing active sound cancellation using two transducers can inflate a bubble in the listener's ear and can pump air to maintain inflation while continuing to play audio program material (hearing aid function, communications, MP3 audio, etc.). This can be achieved by superimposing the audio material signal on the inflation tone in one of the two transducers. The other transducer plays only the inflation tone, but 180 degrees out of phase. The net effect is that the inflation tone is fully or partially cancelled and the audio signal remains intact.

Alternatively, in a two transducer ADEL device, both transducers can play audio material, which may be the same or different, but which is not out of phase and which does not cancel itself out. At the same time, superimposed on this audio material, in each transducer, is the inflation tone. However, the two transducers play the same inflation tone 180 degrees out of phase with one another, producing a cancellation or partial cancellation of the inflation tone, while the audio material from both transducers is heard by the listener.

FIG. 5 shows a schematic of a particular embodiment of the two transducer, two ADEL, device. This example was constructed using the Sonion 44A030 dual transducer, which provides the two transducers needed for the device in a single package. The particular example shown in FIG. 5 uses the device to inflate a donut shaped bubble 32, but the application of the same dual transducer, dual ADEL approach to a closed (driven) bubble is evident based on the designs disclosed in U.S. Provisional Patent Application Ser. No. 61/253,843, filed Oct. 21, 2009, to Ambrose et al., incorporated herein by reference and provided, in part, in Appendix A).

As shown in FIG. 6, a Sonion 44A030 dual transducer, was wired so that the polarity of one of the transducers could be switched relative to the other. To inflate the sealed bubble, the two component receivers of the Sonion 4400 are driven in series with opposite polarity. This action reduces the sound in the receiver tube as heard by the user. Once the desired inflation pressure is reached the inflation signal is switched off and the receiver sections are driven in series with additive polarities.

The prototype in FIG. 6 was constructed and measured so as to determine and confirm the sound pressures that would be available for pumping relative to the sound pressures presented to a hearing aid user. FIG. 7 shows that the difference in sound pressure level (SPL) measured in a Zwislocki Coupler (approximates the signal at the listener's ear drum) is 30 dB lower for the Series Subtraction arrangement, corresponding to the transducers running 180 degrees out of phase, as opposed to Series Addition, where the transducers run in phase. Additionally, the back volume SPL, in either of the two transducers, which is available to create pumping pressure using the ADEL, is 80 dB higher than the SPL experienced by the user with the active cancellation of the inflation tone.

Flat Diaphonic Valve Mounted on the Transducer: FIGS. 8-14

In order to produce the most compact ADEL design for insertion into the ear canal, a flat diaphonic valve was constructed with mounts to the side of a transducer case and which adds 0.4 mm or less to the overall device width. The working principle and practical operation of this flat diaphonic valve is not different from that described in previous provisional patent filings (i.e., U.S. Provisional Patent Application Ser. Nos. 61/176,886, 61/233,465, 61,242,315, and 61/253,843). However, the device disclosed here, has the advantage of compact design fitting onto the side of a balanced armature transducer. The entire device, including the transducer and the diaphonic valve is small enough to fit into the listener's ear, and is small enough to be partially or fully contained within an ADEL bubble.

Figure 8:
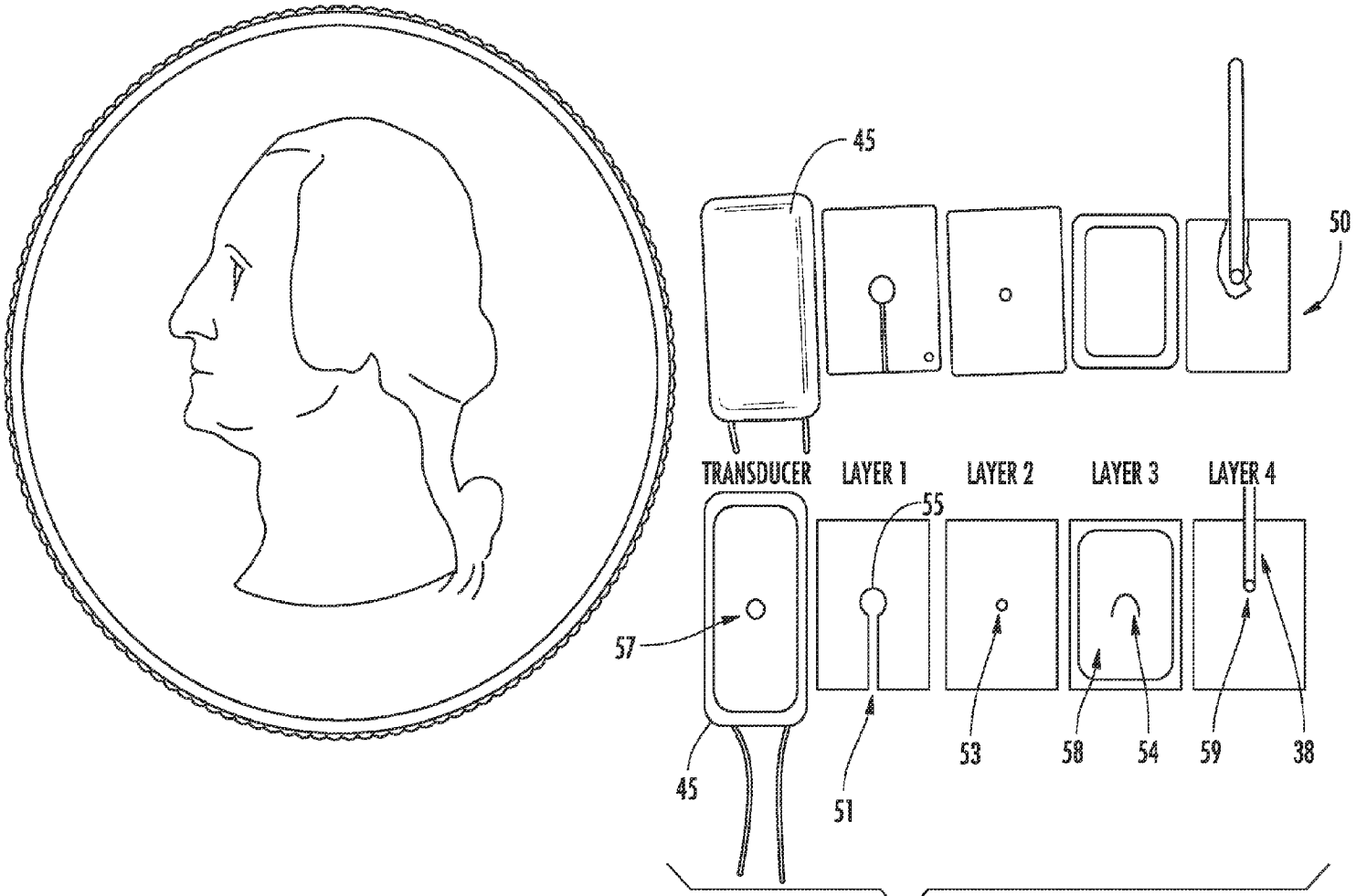
FIG. 8 depicts a photograph of a disassembled diaphonic valve as well as labeled schematics of the component parts that are also shown in FIGS. 23A-26C (for scale purposes, a portion of a U.S. dime is also shown).
Figure 9:
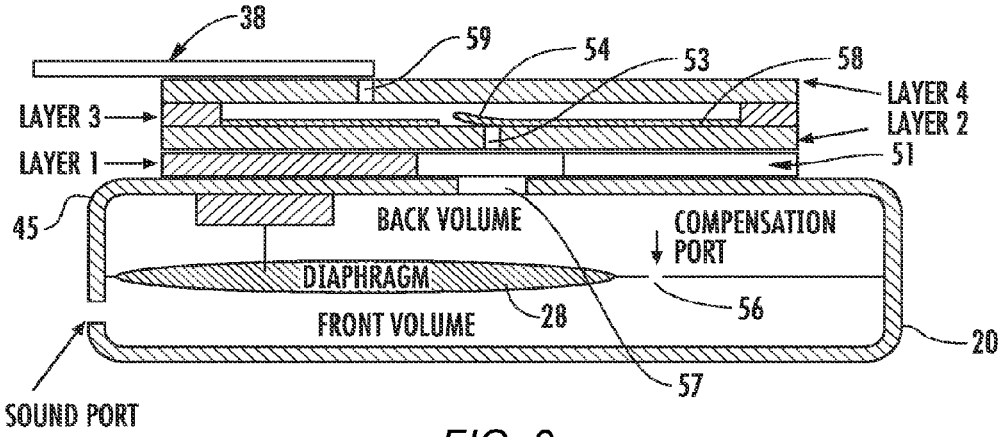
FIG. 9 is a side schematic of the assembled component parts of the diaphonic valve illustrated in FIG. 8, and also shown in FIG. 27D.

FIG. 8 shows a photograph of a disassembled working device as well as labeled schematics of the component parts. A United States dime in the image provides a scale reference. FIG. 9 shows a cross sectional view of the assembled, multilayered device. The device is built on the side of a balanced armature transducer 45, which has a hole 57 in the middle of its outer casing. This hole, is a byproduct of the manufacture of this particular transducer 45, and it leads directly into the back volume of the transducer 45. If no such hole is present on a particular transducer to be fit with a diaphonic valve of this type, then one would need to be drilled. The back volume of the transducer 45 is separated, at least in part, from a front volume of the transducer 45 by a diaphragm 28. A compensation port 56 connects the front volume and the back volume of the transducer 45. Layer 1 of the valve structure is a plate containing a groove 51 or slot which will become an air ingress channel in the final valve, when all the layers are stacked on top of one another. Layer 2 is a plate with a single small hole 53 in it. When assembled, this hole 53 is aligned with the hole 57 in the transducer case 20 as well as with the circular terminus 55 of the air ingress channel. The hole 53 in Layer 2 is the orifice of the synthetic jet, which is the heart of the diaphonic valve. This orifice is smaller than the hole 57 in the transducer case and it is smaller than the circular terminus 55 of the air ingress channel.

Layer 3 of the flat diaphonic valve is a rigid frame with an open center. This central region is spanned by a thin and flexible polymer membrane 58 or film. In this particular device, the membrane used is composed of polyethyleneterephalate (PET). The membrane 58 could be composed of any of the polymer materials disclosed in the U.S. patent application Ser. No. 12/178,236, filed Jul. 23, 2008, and incorporated herein by reference in its entirety, as suitable for use as membranes in diaphonic valves. This membrane 58 could also be a nonpolymer film or foil such as a thin metal foil. The flexible film 58 is mounted on the underside of the rigid frame of Layer 3 so that in the assembled device this flexible film 58 rests directly on the top of the plate of Layer 2. Above this flexible film is a narrow gap, which allows the flexible film space, below the bottom of Layer 4, to flex upward. A flap 54 is cut in the center of the flexible film of Layer 3. In the assembled device, this flap 54 is directly over the synthetic jet port in Layer 2. Layer 4 is a top plate or cover 50 for the diaphonic valve. This cover 50 contains an egress port 59 by which air pumped by the diaphonic valve exits the device. In the particular embodiment shown, this egress port 59 connects to an egress air tube 38, which may be used to route the air into the ADEL bubble for inflation.

Experimentation with prototype ADEL devices has shown that it is often desirable to prevent escape of air from an inflated ADEL bubble by leakage back through the diaphonic valve, during time periods when the diaphonic valve is not pumping, but during which the bubble needs to remain statically inflated. To prevent air leakage back through the diaphonic valve, the diaphonic valve itself can be designed to minimize leakage or a check valve may be added to the diaphonic valve by addition of two more layers to the structure shown in FIGS. 8 and 9.

Figure 10:
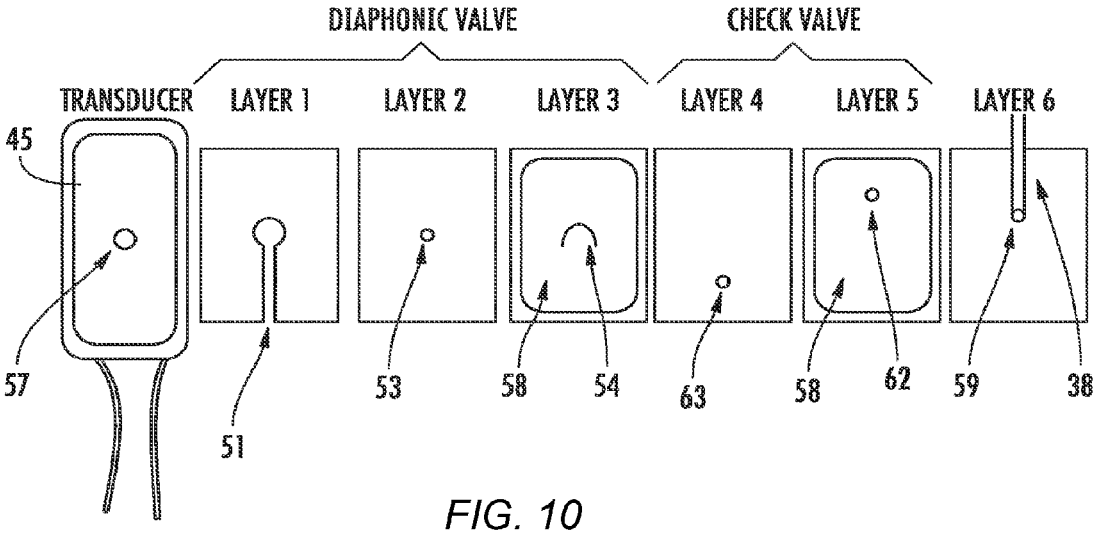
FIG. 10 is a schematic of a disassembled six-layered diaphonic valve in accordance with an embodiment of the present invention, which is also shown in FIG. 28.
Figure 11:
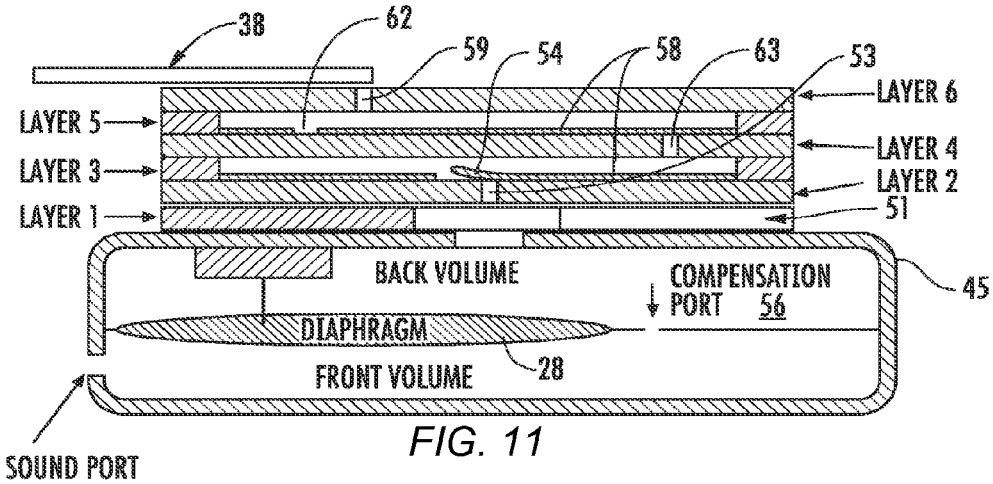
FIG. 11 is a side schematic of the assembled component parts of the diaphonic valve illustrated in FIG. 10, and which is also shown in FIG. 29.

The disassembled layers of the diaphonic valve with the added check valve are shown schematically in FIG. 10. FIG. 11 shows the assembled, six layer structure. Layers 1 through 3 are the same as the first three layers in the flat diaphonic valve discussed previously. Layer 4 is a plate with a single small hole 63 in it. This hole 63 is not in the center of the plate, but is closer to one of the ends of the plate, along its long axis. Layer 5 is a rigid frame with a flexible membrane 58 on its lower side, similar to Layer 3. However, in Layer 5, there is no flap, but rather another small hole 62 in the flexible film 58, which is located at the opposite end of the structure from the hole 63 in the plate of Layer 4. Layers 4 and 5 comprise the check valve. The region of contact of the top of the plate of Layer 4 and the bottom of the film 58 of Layer 5, between the hole 63 in Layer 4 and the hole 62 in the flexible film 58 in Layer 5, comprises the sealing function of the check valve. Placing the holes in Layers 4 and 5 at opposite ends of the structure creates the largest possible valve seat for the check valve and thus improves the seal. The final layer, Layer 6, is the same cover plate with an air egress port 59.

Figure 12A:
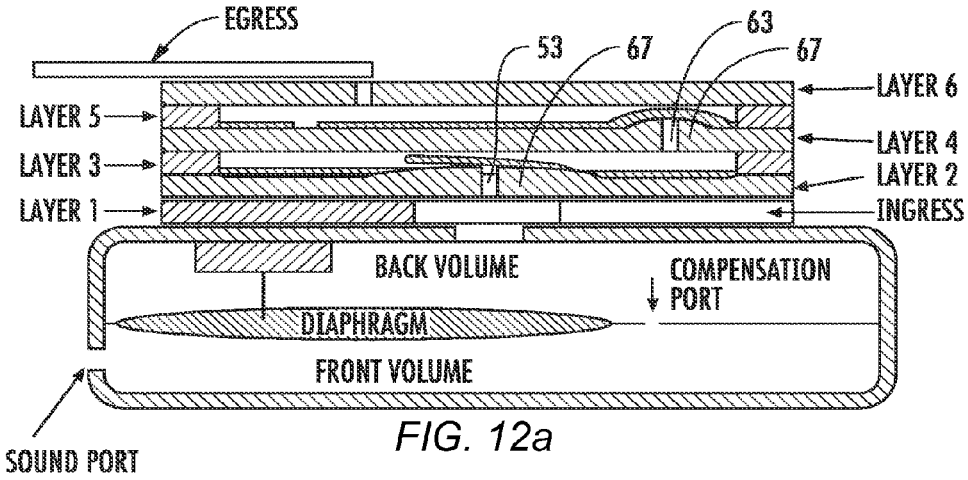
FIG. 12*a* is a side schematic of assembled component parts of a diaphonic valve similar to the embodiment illustrated in FIG. 11.
Figure 12B:
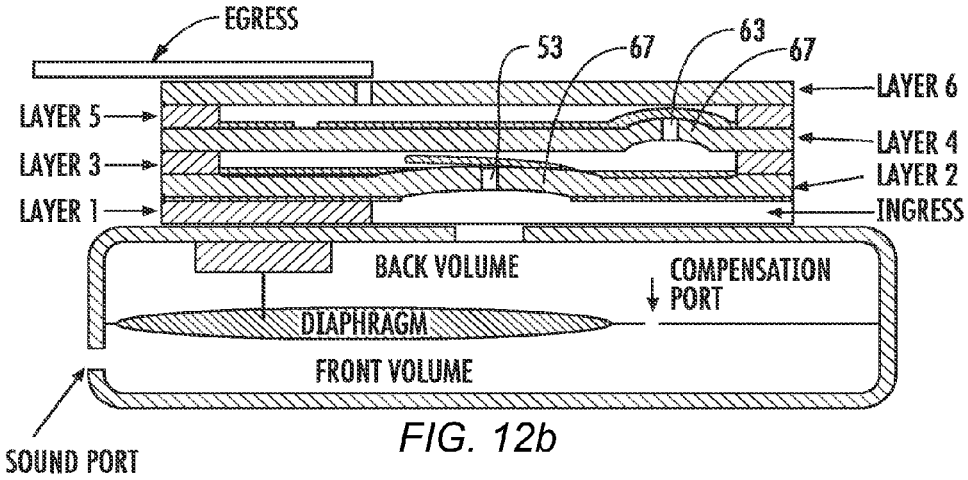
FIG. 12*b* is a side schematic of assembled component parts of a diaphonic valve similar to the embodiment illustrated in FIG. 11.

As shown in FIG. 12, raising the rims 67 around the ports in Layers 2 and 4 improve the seating of the flexible membrane across these ports. This increases the pumping efficiency of the diaphonic valve and produces a tighter seal for the check valve. FIG. 12*a* shows that this can be accomplished by thickening the rims 67 around the ports 53, 63. FIG. 12*b* shows that this can also be accomplished by pushing up or embossing the plate underneath the port. This also raises the rim 67 or lip of the port and produces the desired improvement in performance.

FIGS. 13*a*-13*f* show various ways the flat diaphonic valve 50 mounted on the side of a transducer 20 can be incorporated with an ADEL bubble. These figures show the flat diaphonic valve 50 without the additional check valve. However, the same configurations are possible with a flat diaphonic valve 50 containing a check valve as described above.

Figure 13A:
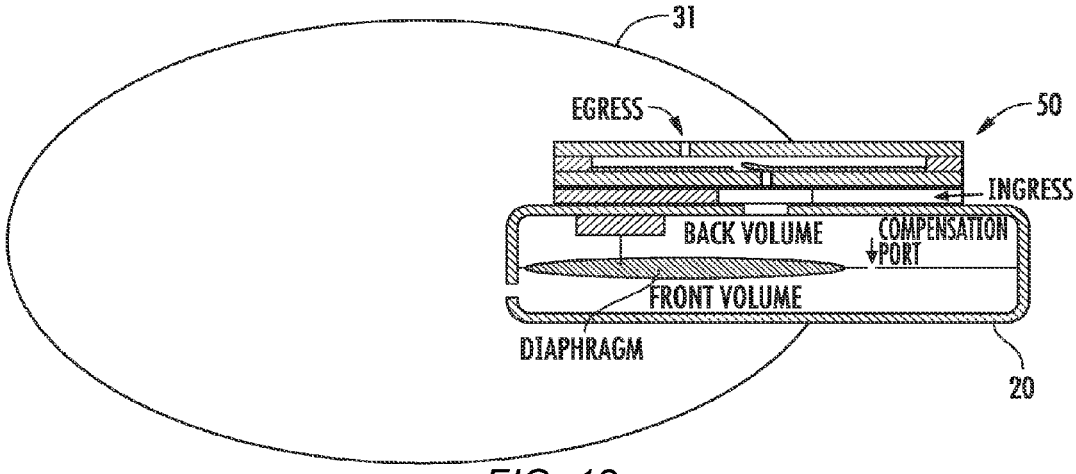
FIG. 13*a* is a side schematic of a driven bubble system with a transducer partially enclosed by the bubble, in accordance with an embodiment of the present invention.

FIG. 13*a* shows a driven bubble system with the transducer partially enclosed by the bubble 31.

Figure 13B:
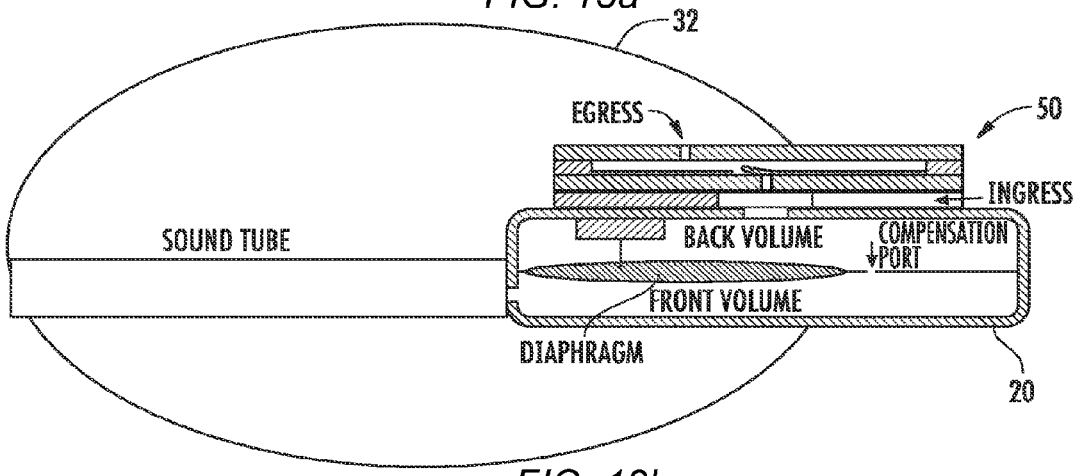
FIG. 13*b* is a side schematic of a driven bubble system with a sound tube fully enclosed and a transducer partially enclosed by the bubble, in accordance with an embodiment of the present invention.

FIG. 13*b* shows a donut shaped bubble 32 with a sound tube and the transducer 20 partially enclosed in the bubble 32.

Figure 13C:
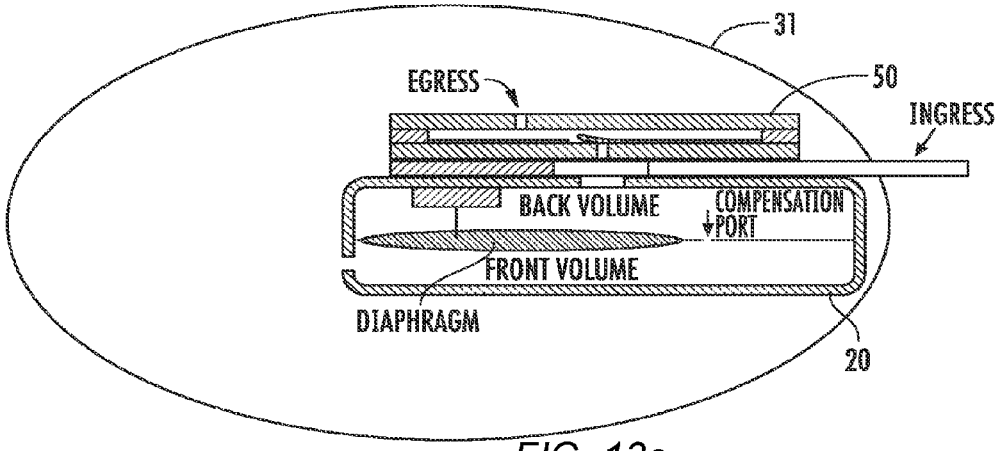
FIG. 13*c* is a side schematic of a driven bubble system with a transducer fully enclosed by the bubble, in accordance with an embodiment of the present invention.

FIG. 13*c* shows a driven bubble system with the transducer 20 fully enclosed by the bubble 31.

Figure 13D:
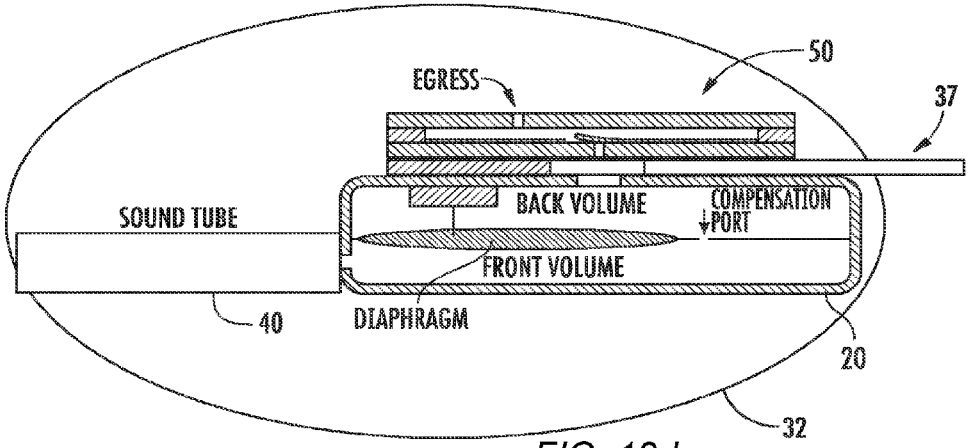
FIG. 13*d* is a side schematic of a driven bubble system with a sound tube and a transducer fully enclosed by the bubble, in accordance with an embodiment of the present invention.

FIG. 13*d* shows a donut shaped bubble 32 with the transducer 20 fully enclosed by the bubble and using an ingress tube 37 to connect to groove 51 in Layer 1. A sound tube 40 is surrounded by the donut shaped bubble 32.

Figure 13E:
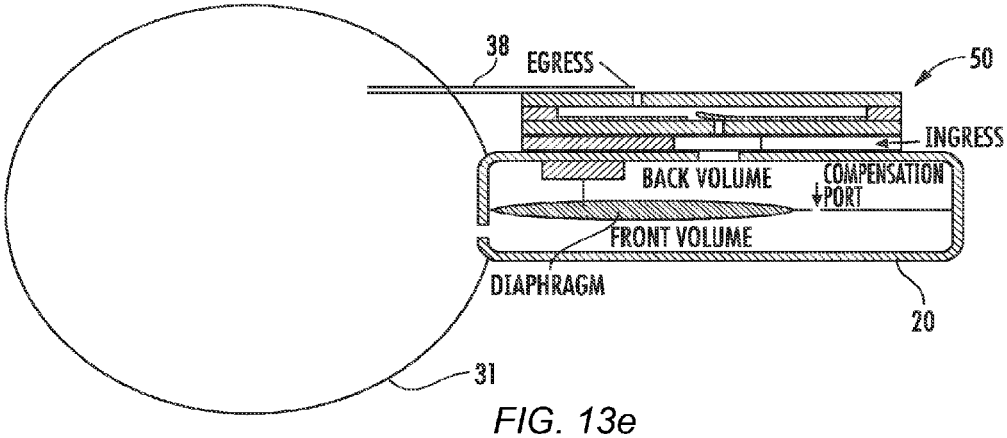
FIG. 13*e* is a side schematic of a driven bubble system with a transducer outside of the bubble, in accordance with an embodiment of the present invention.

FIG. 13*e* shows driven bubble 31 with the transducer 20 completely outside the bubble 31.

Figure 13F:
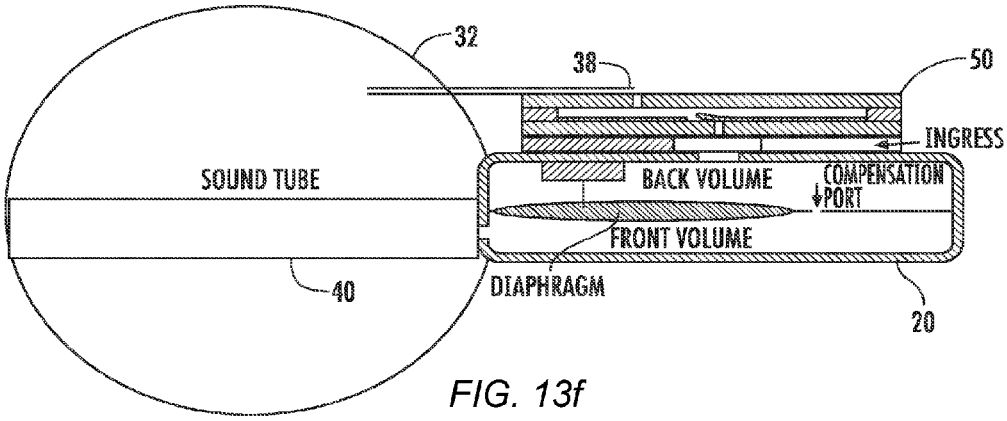
FIG. 13*f* is a side schematic of a driven bubble system with a sound tube fully enclosed and a transducer outside of the bubble, in accordance with an embodiment of the present invention.

FIG. 13*f* shows a donut shaped bubble 32 with the transducer 20 completely outside the bubble 32.

Figure 14:
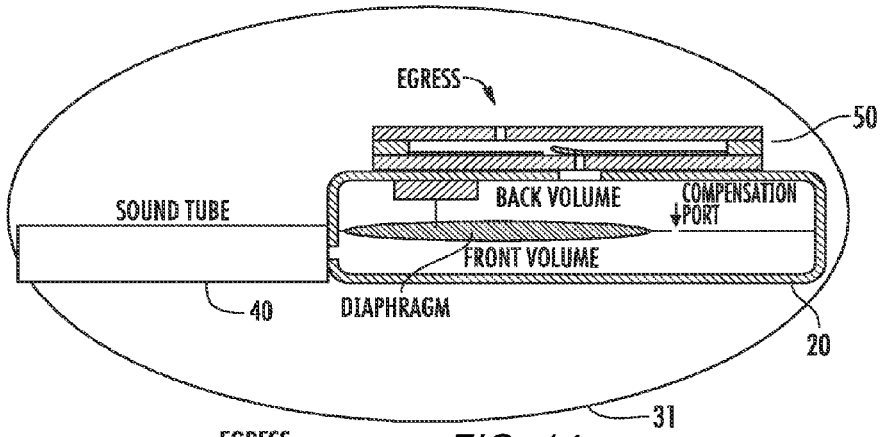
FIG. 14 is a side schematic of a driven bubble system with a sound tube and a transducer fully enclosed by the bubble similar to the embodiment of FIG. 13*d*, in accordance with an embodiment of the present invention.

FIG. 14 shows an embodiment of the ADEL with the flat diaphonic valve 50 in which the air ingress channel is absent. This is shown with the transducer 20 fully enclosed within the ADEL bubble 31, but other embodiments lacking an air ingress port can also be partially enclosed by the bubble 31 or completely outside the bubble 31.

In the device lacking an air ingress channel, air to inflate the bubble is drawn from the ear canal, down the sound tube 40, into the front volume of the transducer 20, through the pressure compensation port 56, into the back volume of the transducer 20, through the pumping diaphonic valve 50 and finally into the bubble 31. This embodiment has the advantage of using air pressure to pull the bubble 31 into the listener's ear, producing a good acoustic seal.

More details of the flat valve subassembly of the receiver(s) and its use within various bubble-type hearing aids and listening devices will be described below in FIGS. 21-29.

Figure 15:
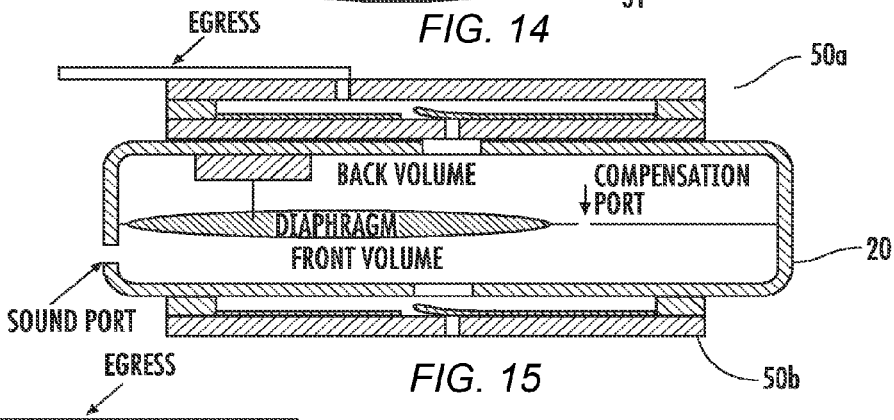
FIG. 15 is a side schematic illustrating two flat diaphonic valves attached to a single transducer, in accordance with an embodiment of the present invention.
Figure 16:
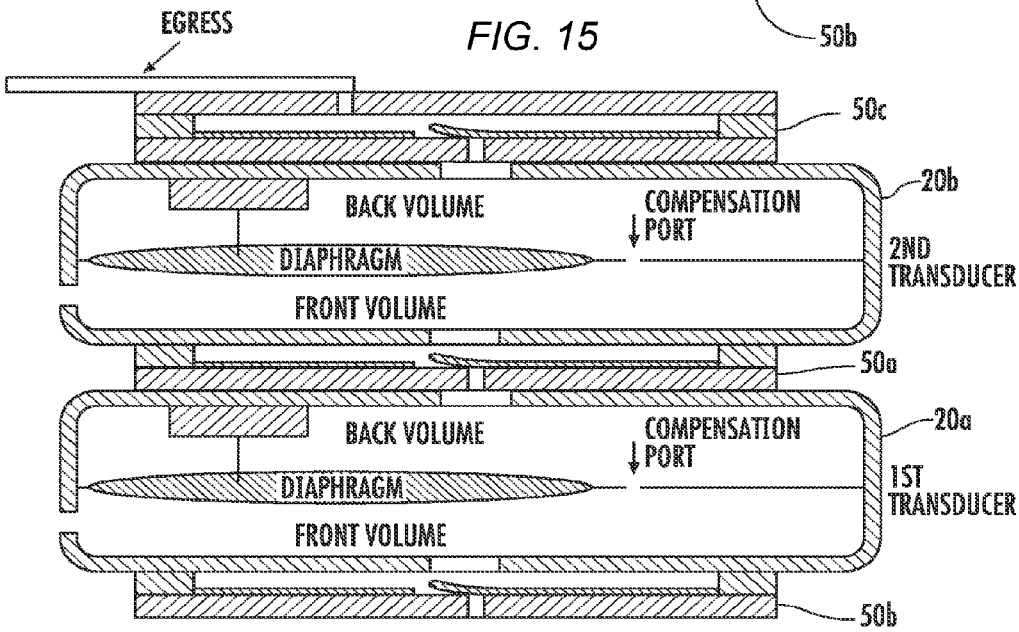
FIG. 16 is a side schematic illustrating a stack of flat diaphonic valves and two transducers, in accordance with an embodiment of the present invention.
Figure 17:
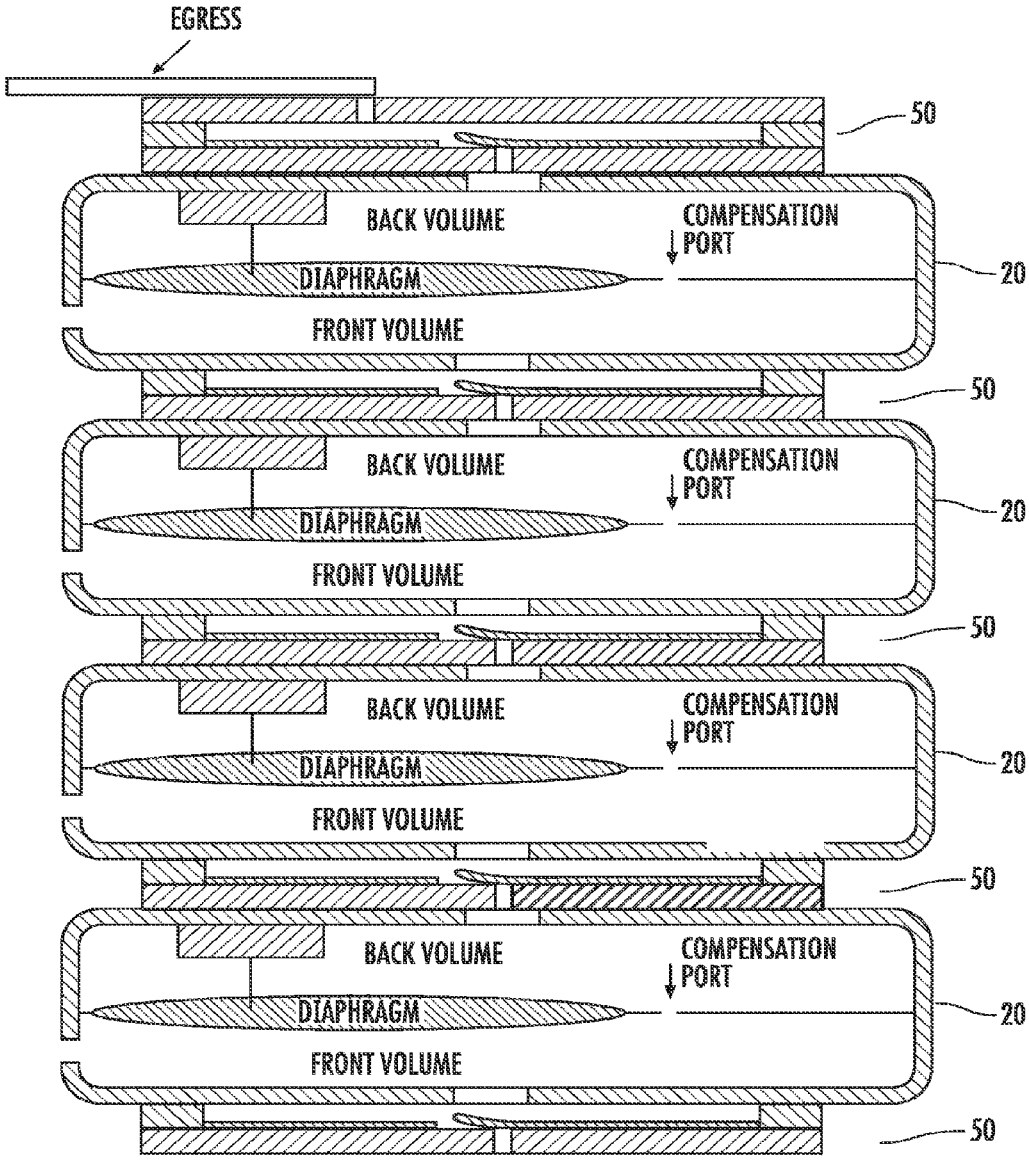
FIG. 17 is a side schematic illustrating a plurality of diaphonic valves alternating with transducers, in accordance with an embodiment of the present invention.

Multiple Diaphonic Valves to Boost Pressure Output: FIGS. 15-17

FIG. 15 shows an embodiment where two flat diaphonic valves 50*a*, 50*b* are attached to a single transducer 20. The diaphonic valve 50*b* on the front volume is turned around to pump from outside into the front volume, thus pressurizing the front volume. This pressure leaks through the compensation port into the back volume, thus increasing the pressure of the back volume. The other diaphonic valve 50*a* on the back volume further increases pressure and pumps air out of the device via the egress port. This device can produce higher pressures than the single diaphonic valve on the back volume only. With two diaphonic valves, the first valve 50*b* increases pressure inside the transducer 20 and the second 50*a* boosts pressure even more before egress. The device in FIG. 15 is illustrated using flat diaphonic valves. However, this same arrangement will also work with any of the previously disclosed diaphonic valve designs (i.e., U.S. patent application Ser. No. 12/178,236, filed Jul. 23, 2008, and U.S. Provisional Patent Application Ser. Nos. 61/176,886, 61/233,465, 61/242,315 and 61/253,843, filed May 9, 2009, Aug. 12, 2009, Sep. 14, 2009 and Oct. 21, 2009, respectively, and all of which are incorporated herein, by reference).

FIG. 16 shows that it is possible to stack two transducers 20*a*, 20*b* together with a diaphonic valve 50*a* between them and with additional diaphonic valves 50*b*, 50*c* on the front volume (50*b*) of the first transducer 20*a* and on the back volume (50*c*) of the second transducer 20*b*.

This produces a cascade of pressure increases. Each transducer and diaphonic valve combination can only increase the pressure so much (about 1 kPa at most). However, by stacking the devices as shown, the second transducer/diaphonic valve combination begins with air which has already been pressurized. It can thus boost the pressure higher. When operating a device such as that shown in FIG. 16 it is necessary to coordinate the phase of the inflation tones between the two transducers to ensure that the diaphonic valves all work in the same direction. Additionally, the diaphonic valve which sits between transducer 1 and transducer 2 necessitates that the two transducers have their inflation tones in phase with one another.

FIG. 17 carries the concept of a stack of transducers and diaphonic valves even further. One can build stacks of arbitrary numbers of alternating transducers and diaphonic valves to generate higher and higher pressure. The pressures achievable will eventually be limited by the mechanical strength of the components to resist increasing pressure.

The devices shown in FIGS. 16 and 17 have open sound ports, and will thus tend to allow some pressure to escape from the stack of transducers and diaphonic valves. Other embodiments may have some or all of these sound ports blocked to create even greater pressures. Embodiments of the devices in FIGS. 16 and 17 may have variations in the flow and sound impedance of the compensation ports (for instance by changing the size of the ports) as one progress up the stack of transducers. This may help to prevent back flow of pressure in the device. The transducers in a stack such as FIGS. 16 and 17 may be run in phase or with other complex combinations of phase and amplitude differences to produce different pressure and sound outputs from the device.

The devices of FIGS. 16 and 17 illustrate interleaved balanced armature transducers and diaphonic valves. Similar stacked devices for the purpose of pressure generation, pumping, and sound generation can be produced by interleaving diaphonic valves with other sound generating devices, such as piezoelectric diaphragms, or moving coil speakers. In these cases the piezoelectric diaphragms or speakers may have small compensation ports in them or in their surrounds in order to allow pressure to move from the front volume to the back volume or vice-versa.

Multi-Chambered Bubble from Joined Inflated Tubes: FIG. 18

Figure 18A:
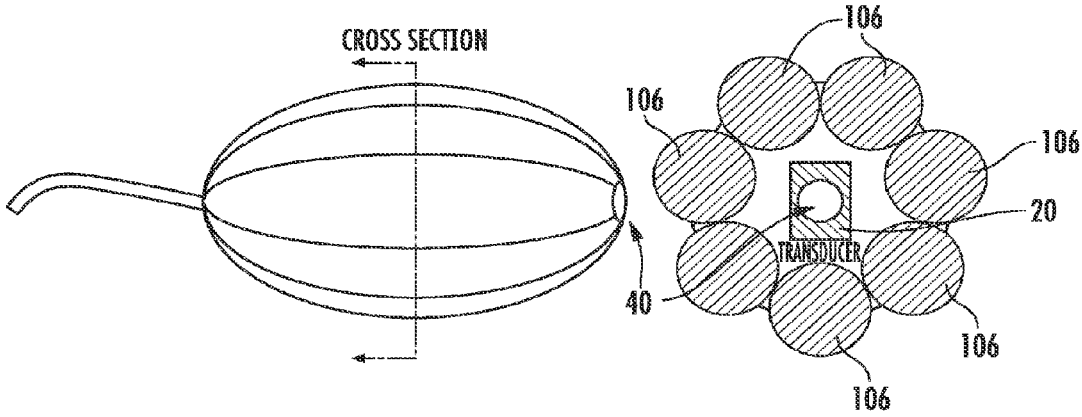
FIG. 18*a* is a side and cross-sectional schematic of a multi-tube inflatable member, in accordance with an embodiment of the present invention.
Figure 18B:
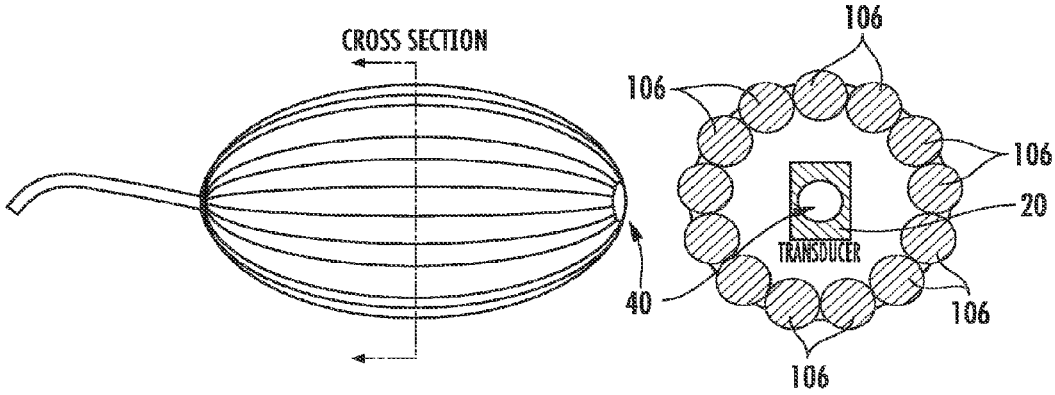
FIG. 18*b* is another side and cross-sectional schematic of a multi-tube inflatable member, in accordance with an embodiment of the present invention.

In the Sep. 14, 2009 U.S. Provisional Patent filing, Ambrose et al. (61/242,315) disclosed a design for a two walled, ADEL bubble, in which the required inflation volume is minimized by having the interior of the bubble un-pressurized. FIG. 18 shows an example of a similar type of bubble design produced by bundling together inflatable polymer tubes. FIG. 18*a* shows that using fewer, larger diameter tubes 106 gives a thicker bubble wall, while FIG. 18*b* shows that using a larger number of smaller diameter tubes 106 produces a thinner bubble wall.

This design requires a circular pressure manifold, whereby pressure generated by the diaphonic valve is distributed to each of the tubular bubble wall sections. The example shown in FIG. 18 is that of a bubble which encloses the transducer 20. This same bubble design can also be incorporated into an ADEL device in which the transducer is outside the bubble or is partially enclosed by the bubble.

The inflatable, tubular sections of the device in FIG. 18 may be adhered together laterally by an adhesive or melt or solvent bonding process. Alternatively the tubular sections may be left un-bonded laterally along their lengths. In this case the tubes 106 are only joined together at or near their two ends. The inflation of the un-joined tubes rigidifies the structure and give the bubble its shape.

Such an ADEL bubble can be formed from as few as 6 tubes and as many as twenty or more. The number of tubes is eventually limited by the need to distribute air flow and pressure to all of them via a pressure manifold.

Figure 19:
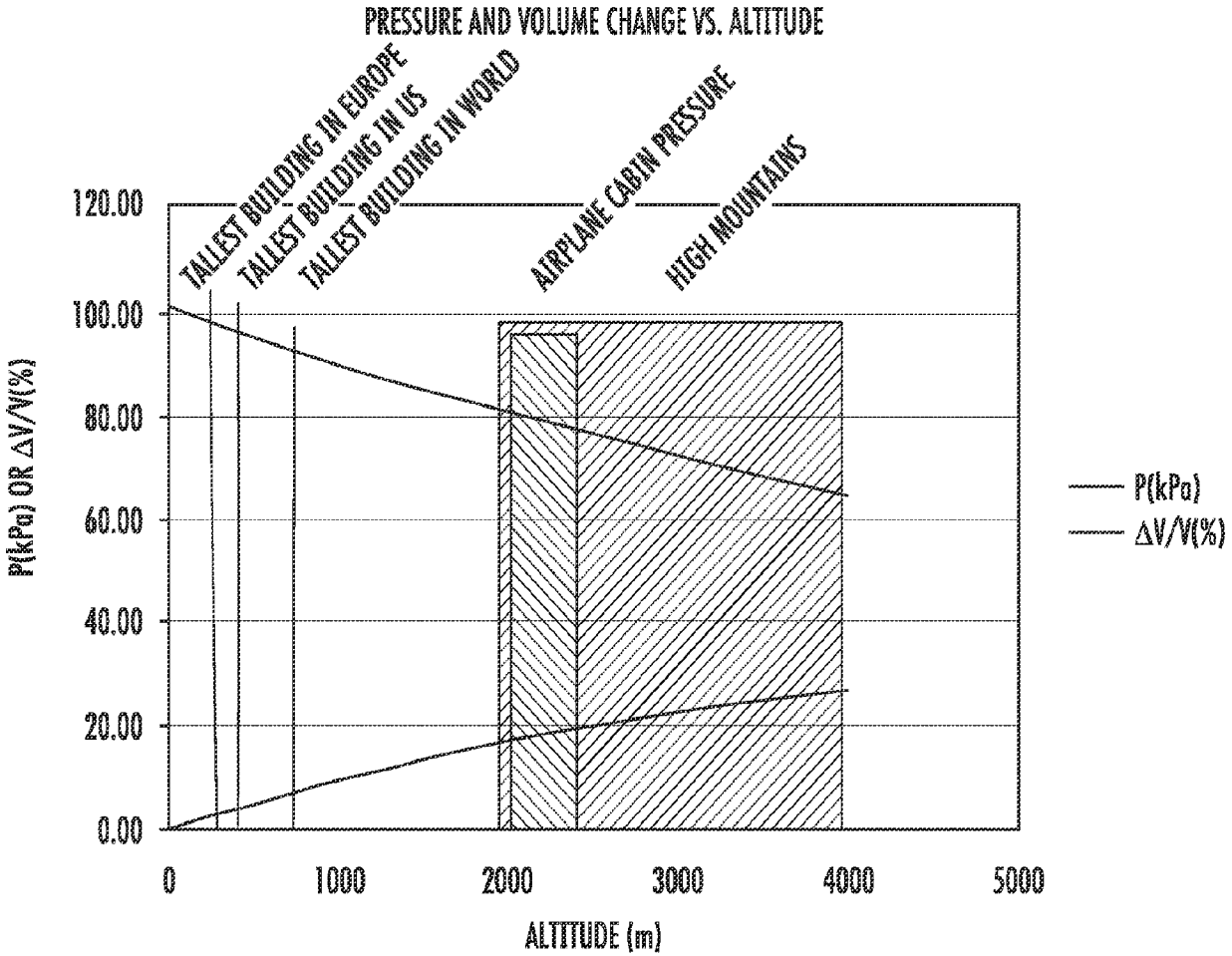
FIG. 19 is a graphic illustration of pressure and volume changes along a range of altitudes.

Influence of Atmospheric Pressure on the Bubble: FIGS. 19-20

An inflatable ear canal sealing device, such as the ADEL, must be able to tolerate changes in the outside atmospheric pressure without either loosing its seal or causing wearer discomfort. For instance, if a listener with an inflated bubble in his ear ascends rapidly to the top of a tall building or ascends in an airplane, the resulting drop in atmospheric pressure will allow the bubble in the ear to expand. Too much expansion of the bubble in the ear may cause discomfort. Conversely, if a listener with an inflated bubble in his ear descends rapidly from the top of a tall building or descends in an airplane, the resulting increase in atmospheric pressure will reduce the bubble volume. Too much contraction of the bubble may cause the loss of the acoustical ear seal.

As a first step, it is necessary to determine the maximum atmospheric pressure changes that the inflated ADEL bubble might experience in a listener's ear. Then, it is necessary to design the bubble and inflation system to tolerate these atmospheric pressure changes without undue adverse effects of the type discussed in the previous paragraph.

For the air in the ADEL bubble, $pV=\text{constant}$, where p is pressure and V is volume. This is a subpart of the ideal gas glass called Boyle's Law. It is valid for air over the range of pressures, temperatures and humidities found on Earth.

$\Delta p$=change in pressure from initial value P $\Delta V$=change in volume of bubble from initial value V Then $pV=\text{constant}=(p+\Delta p)(V+\Delta V)$ This can be rearranged to show that:

$\Delta V/V$=Fractional Change in Volume$=(1/(1+\Delta p/p))-1$

In this equation $\Delta V/V$ and $\Delta p/p$ necessarily have opposite signs. i.e. a positive increase in pressure $\Delta p/p$ leads to a negative change in volume $\Delta V/V$. Note that $-(100\%)*\Delta V/V$ gives the percentage change in volume of an inflated ADEL bubble (as positive number) that must be dealt with due to a pressure change.

FIG. 19 shows a plot of atmospheric pressure vs. altitude in meters constructed using a barometric pressure calculator on the web: http://hyperphysics.phy-astr.gsu.edu/hbase/Kinetic/barfor.html. The calculations suggest that elevator rides in tall buildings should not pose much of a problem for the ADEL bubbles. The tallest building in the World is 800 m high and thus a bubble would decrease its volume by 8% upon ascending from the bottom (at sea level) to the top. The other very tall buildings in the world, in the US and Asia, are in the 500 m range and represent a volume decrease of 5%. The tallest building in Europe is 300 m (similar to the Eiffel tower) and this gives a bubble volume change of 3%.

Figure 20A:
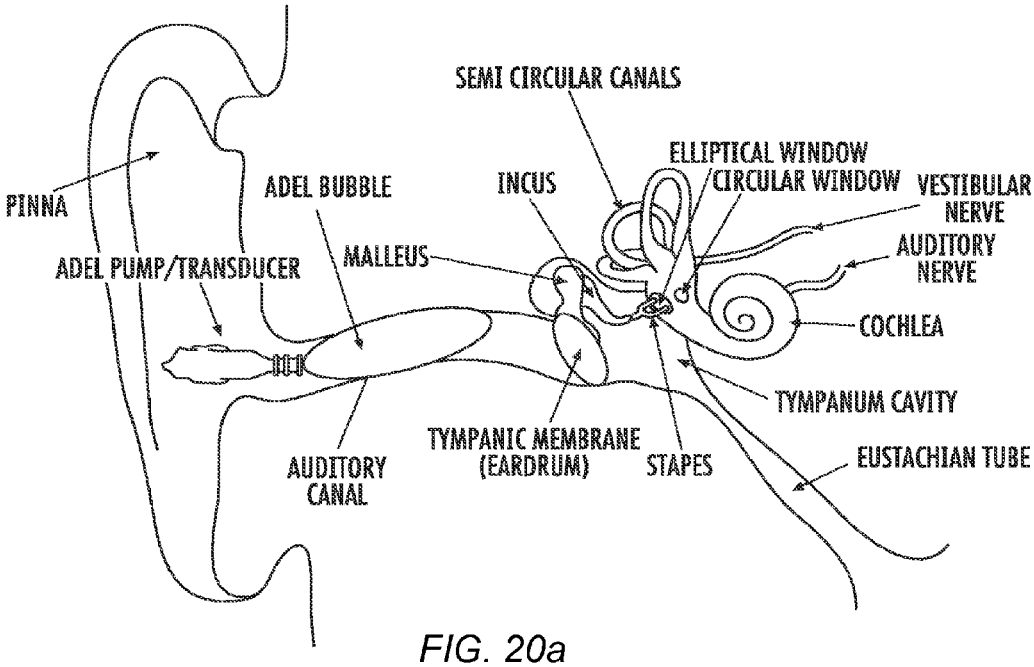
FIG. 20*a* is an illustration of an embodiment of the present invention inserted within an ear.
Figure 20B:
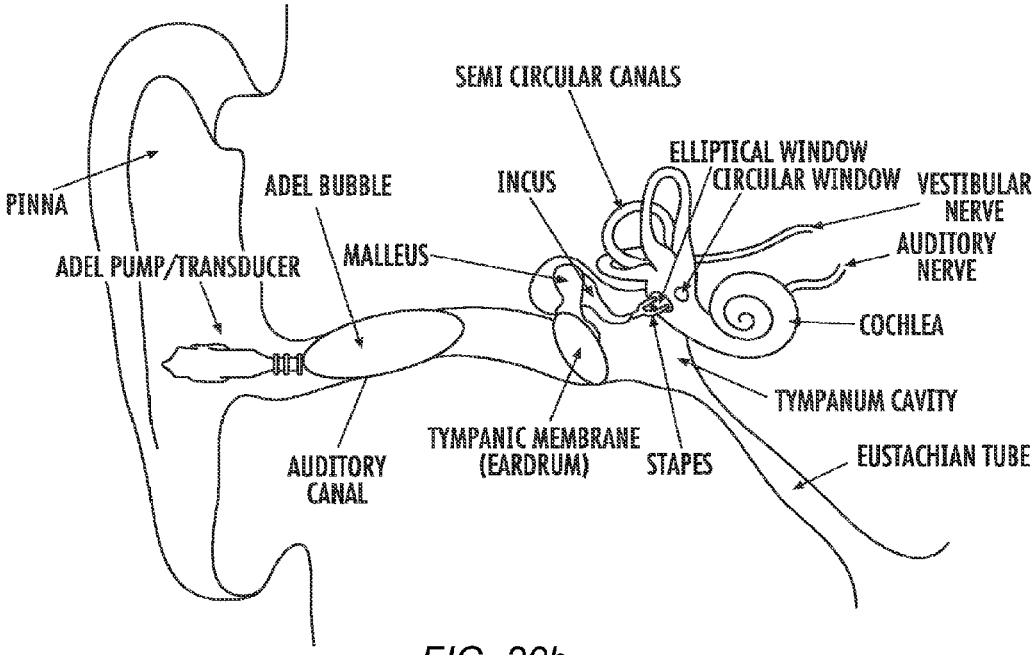
FIG. 20*b* is an illustration similar to FIG. 20*a*.

Airplane rides and trips to the high mountains are more of a challenge. As FIG. 19 shows, these can result in ADEL bubble volume changes in the 15% to 25% range. FIG. 20 shows an ADEL bubble, in the ear, as it undergoes a significant change in outside atmospheric pressure. The bubble lays in the ear canal like a loosely inflated bag, and it makes contact with a significant length of ear canal wall. At lower atmospheric pressure (FIG. 20*a*), the bubble is larger and this manifests itself as the bubble extending a little further along the ear canal. At higher atmospheric pressure (FIG. 20*b*), the bubble is smaller and this manifests itself as the bubble extending a little less distance along the ear canal. The difference in bubble volume and position in the ear canal between FIGS. 20*a* and 20*b* is not significant enough, even with a 25% change in bubble volume (the worst case scenario) to cause listener discomfort or to disrupt the acoustic seal in the ear.

Wrinkles in the ADEL bubble surface may result from the natural resting of the bubble along the ear canal surface which may be rough, for instance, by the presence of hairs. Also the bubble surface may be intentionally wrinkled by embossing or another mechanical or chemical processing technique. Wrinkles in the bubble wall aid the bubble in accommodating slight or moderate volume changes, in response to slight or moderate changes in the external atmospheric pressure.

Details of the Receiver's Flat Valve Subassembly and its Use in a Bubble-Type Hearing Aid or Listening Device System: FIGS. 21-29.

Figure 21A:
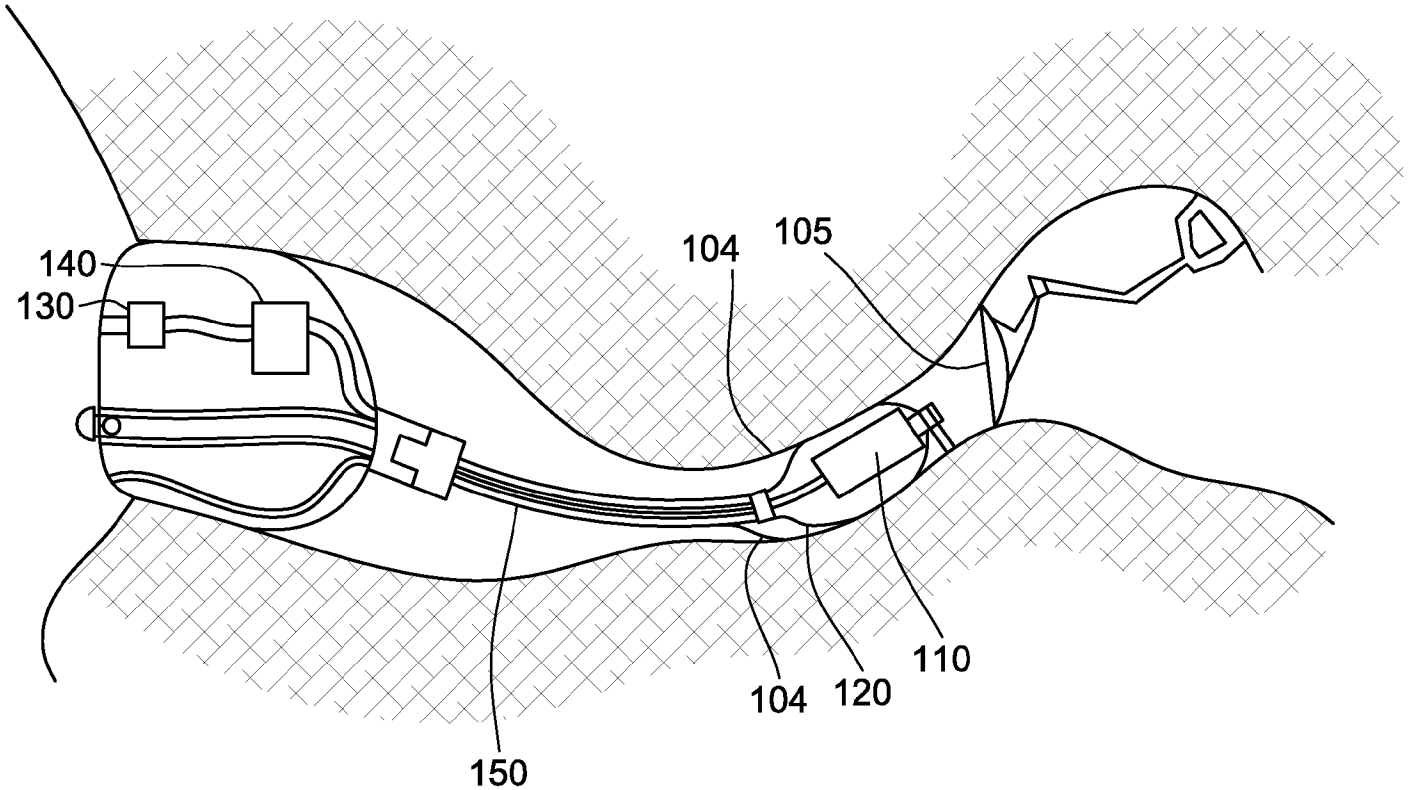
FIG. 21A provides a diagram of a hearing aid mounted within an ear canal.

FIG. 21A provides a diagram of a hearing aid mounted within an ear canal. The hearing aid includes a microphone 130, a processor 140, and a receiver 110. The receiver 110 is securely lodged against the ear canal inner wall 104 and held in place by the force of the expanded balloon 120 against the ear canal inner wall 104. The receiver 110 includes a sound port and is oriented within the ear canal with its sound port facing the tympanic membrane 105 (i.e. the ear drum). The processor 140 is coupled to the receiver 110 via an electrical conductors 150.

In an exemplary operation of the hearing aid shown in FIG. 21A, acoustic waves are detected by the microphone 130. The microphone 130 generates electrical signals indicative of the detected acoustic waves and sends the electrical signals to the processor 140. The processor 140 then analyzes the electrical signals and optionally amplifies desirable characteristics of the signals to create the electrical input signals transmitted to the receiver 110 via the electrical conductors. The receiver 110, which is symbolically illustrated by the functional block diagram in FIG. 21B, includes a diaphragm driven by a rod according to the electrical input signals. The driven diaphragm creates acoustic waves (i.e. sound waves) and the acoustic waves emanate outwardly from the sound port toward the tympanic membrane 105. The acoustic waves generated in the receiver 110 excite the tympanic membrane 105 by causing it to vibrate, which causes the human auditory sensory system to be engaged and thereby generate electrical signals sent to the brain that create the perception of sound.

Figure 21B:
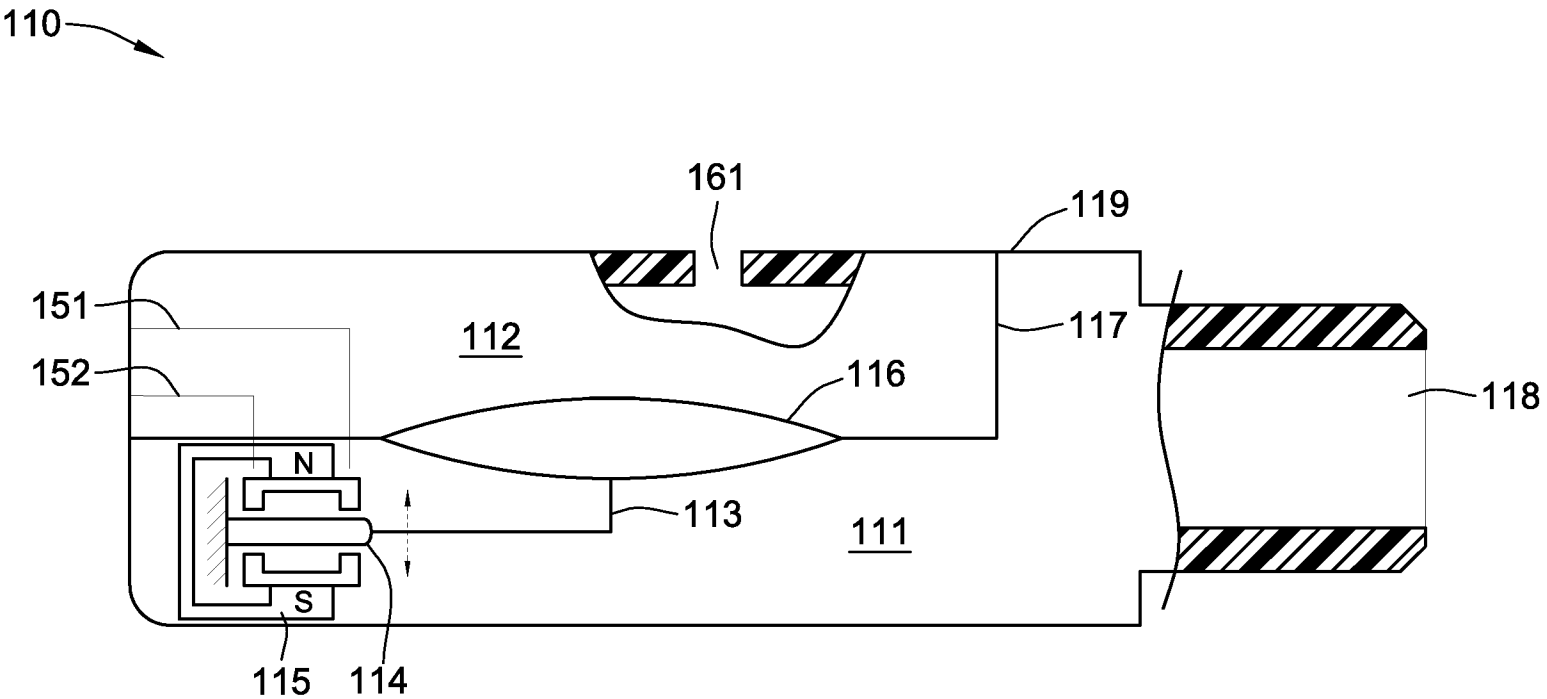
FIG. 21B is a functional block diagram of a cross-section of a balanced armature receiver.

FIG. 21B is a functional block diagram of a cross-section of a balanced armature receiver 110. The receiver 110 includes a housing 119, which houses a front volume 111 and a back volume 112. The front volume 111 and the back volume 112 can be separated by an internal wall 117. The front volume 111 and the back volume 112 are also separated, at least in part, by a diaphragm 116. The diaphragm 116 is configured to be driven to create acoustic waves within the front volume 111 according to the electrical input signal 150 transmitted on the first and second input signal wires 151, 152. The diaphragm 116 generates the acoustic waves when the driving rod 113 is oscillated through a coupling to a pivoting element 114 to push and pull the diaphragm and thereby generate pressure waves in the front volume 111. The pivoting element 114 is oscillated according to electrodynamic forces generated by a time-changing magnetic field created by the input signal transmitted on the input contacts 151, 152 of the receiver 110.

The front volume 111 also includes an associated sound port 118 that allows acoustic waves generated within the front volume 111 to escape the receiver 110. The input signals cause movement of an armature 114. The armature 114 is coupled to a driving rod 113 for driving the diaphragm 116 and is positioned between a permanent magnet 115. The movement of the armature 114 can then cause the driving rod 113 to be driven up and down and thereby cause the diaphragm 116 to oscillate and thereby generate acoustic waves in the front volume 111. The acoustic waves are then emitted from the sound port 118, and can be directed toward a tympanic membrane of a user.

While the functional block diagram of the balanced armature receiver 110 provided in FIG. 21B provides a particular implementation of a pivoting element coupled to a driving rod to generate acoustic pressure waves by oscillating a diaphragm, the present disclosure is not so limited to the particular arrangement shown in FIG. 21B. The present disclosure expressly contemplates the use of the valve subassembly with any audio transducer, including other forms of receivers and also with microphones.

Figure 21C:
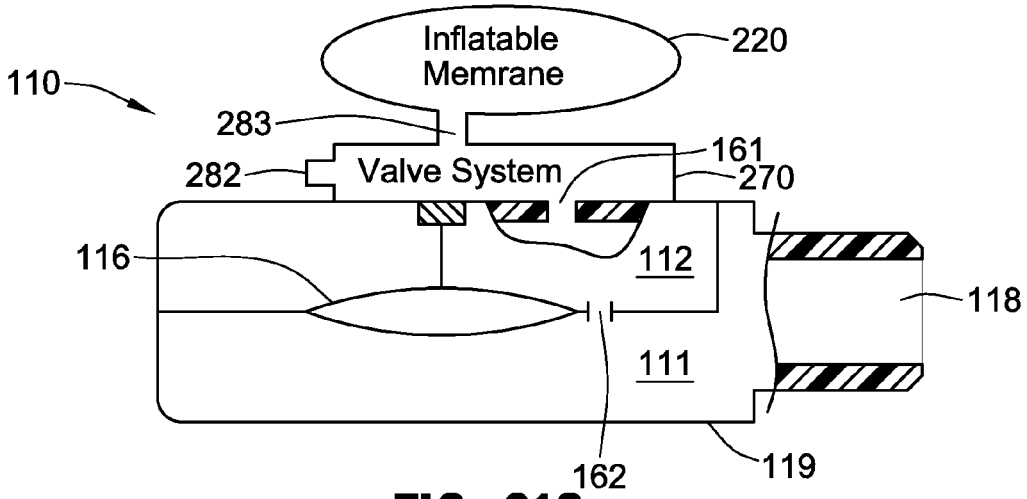
FIG. 21C provides a block diagram view of the receiver having a valve subassembly for use in inflating an inflatable membrane.

FIG. 21C provides a block diagram view of the receiver 110 with the valve subassembly 270. The front volume 111 is continuous with, and in fluid communication with, the sound port 118. In addition to the sound port 118, the housing 119 of the receiver 110 includes an inflation port 161, which penetrates the housing 119 into the back volume 112. The receiver 110 also typically includes a compensation port 162, which can be a hole in the internal wall separating the front volume 111 from the back volume 112. The compensation port 162 can also allow for the equalization of static barometric pressure between the back volume 112 and the front volume 111. An excess of pressure on one side of the diaphragm 116 over the other will bias its vibrations and modify (impede) its sound generating characteristics. The compensation port 162, or pressure equalization port, provides a small physical pathway by which air can move between the front and back volumes 111, 112 thus equalizing pressure between them. The compensation port 162 can be placed anywhere in the inner housing, including in a flexible surround that seals the diaphragm 116 with the inner housing 117. The compensation port 162 can also advantageously prevent undesirable pressure levels from being applied to the ear drum, which may be in fluid connection with the front volume 111. In an implementation, more than one compensation port 162 may be provided between the front volume 111 and the back volume 112.

The valve subassembly 270 of the receiver 110 is for use in inflating an inflatable membrane 220. The valve system 270 has an ingress port 282 and an egress port 283. The egress port 283 is coupled to the inflatable membrane 220 such that the egress port 283 is in fluid communication with an interior volume of the inflatable membrane 220. The valve system can be configured to maintain a static pressure differential between the ingress port 282 and the egress port 283 by harvesting pressurized air generated in the back volume 112 by the driven diaphragm 116 during sound generation, and then preventing the pressurized air from flowing back out of the valve subassembly 270 through either the ingress port 282 or the fluid connection 281 with the back volume 122. The valve subassembly 270 may incorporate flap valves or check valves constructed from various materials, for example, stretched polyethylene terephthalate (PET) or polyurethane (PU). The check valves or flap valves within the valve system 270 can be configured such that high pressure air can enter valve system 270 from the back volume 112 by overcoming the tension of the stretched PET materials.

The inflatable membrane 220 can be a balloon or membrane (a "bubble"), and can be used to produce a comfortable, adjustable and variable ear seal and works with the ear canal to produce a variable volume resonant chamber for safe, comfortable, rich sounding and high fidelity reproduction of audio. In an implementation, the inflatable membrane 220 can be configured to surround the receiver module, and provide a seal against the ear canal of a user, similarly to the inflatable membrane 120 shown in FIG. 21A. Alternatively, the inflatable membrane 220 can be configured to partially surround the receiver module, or to not surround the receiver module at all.

Figure 22:
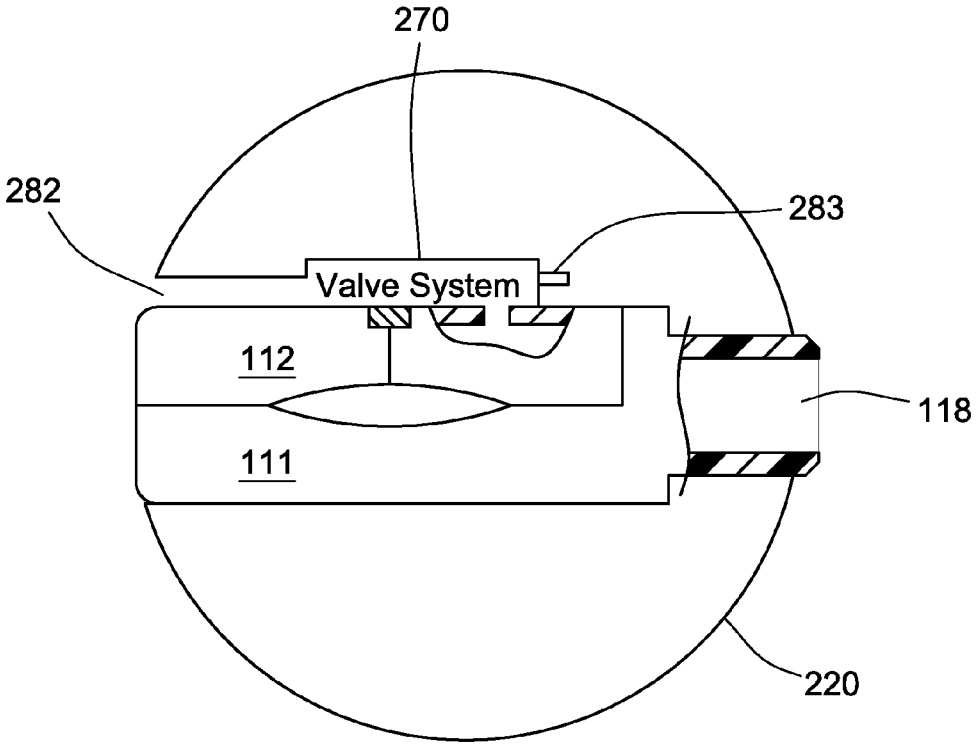
FIG. 22 provides a block diagram of a receiver module having a valve subassembly for use in inflating an inflatable membrane that surround the receiver module.

FIG. 22 provides another block diagram of a receiver having its valve subassembly 270 for use in inflating an inflatable membrane 220 that surrounds the receiver module. The back volume 112 also includes an inflation port in fluid connection with an ingress port 282 for providing ambient air into the valve subassembly 270. As egress port 283 provides a fluid communication between the valve system 270 and an interior volume of the inflatable membrane 220. In an implementation of the receiver module shown in FIG. 22, the ingress port 282 can be on opposite side or same side as of the receiver module as the sound port 118. In an implementation of the present disclosure, the valve system 270 is configured such that pressure waves generated by the oscillation of the diaphragm cause air to be displaced, or pumped, from the ingress port 282 to the egress port 283. The pumping of the valve system 270 by driving the diaphragm causes the inflatable membrane 220 to inflate.

FIGS. 23-27 illustrate particular configurations of the valve subassembly 270 for use in the receiver module 110 for inflating the inflatable membrane 220. The particular configuration shown is a multi-layer valve system, or valve subassembly, or valve structure, that is typically attached to the housing of a audio transducer having an inflation port 161. The audio transducer utilizing the multi-layer valve system 270 may be, for example, a Sonion 44A030 receiver.

To produce the most compact design for insertion into the ear canal, a flat diaphonic valve may be constructed which mounts to the side of a transducer housing and which adds 0.4 mm or less to the overall device width. The multi-layer valve system disclosed here, has the advantage of compact design fitting onto the side of a balanced armature transducer. The entire device (i.e., the receiver module 110), including the transducer and the diaphonic valve is small enough to fit into the listener's ear, and is small enough to be partially or fully contained within the inflatable membrane 220.

Figure 23A:
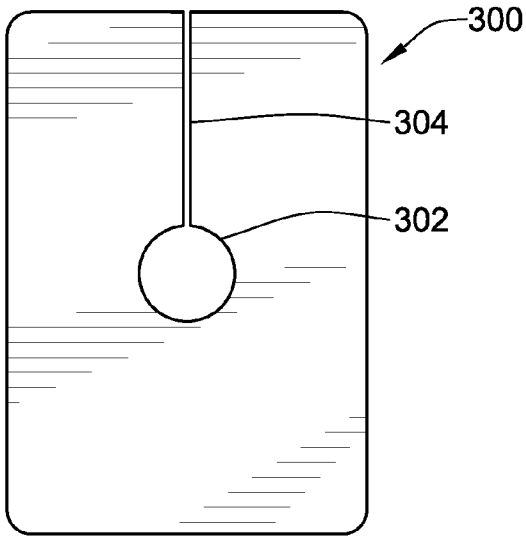
FIG. 23A is a top view of a first layer of the multi-layer valve system.
Figure 23B:
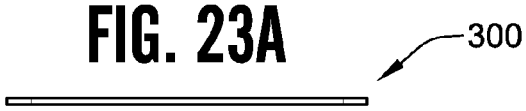
FIG. 23B is a side view of the first layer of the multi-layer valve system.
Figure 23C:
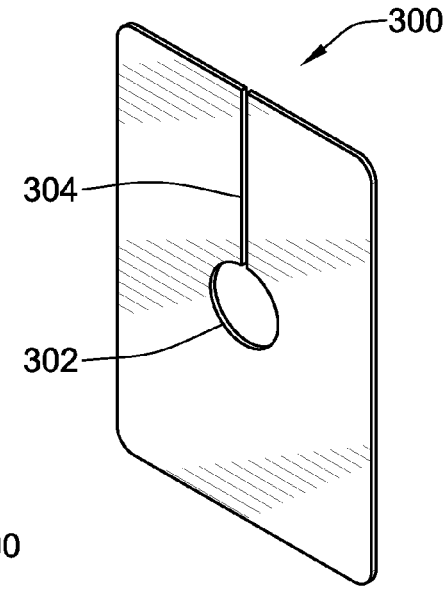
FIG. 23C is an aspect view of the first layer of the multi-layer valve system.

FIG. 23A is a top view of a first layer 300 of the multi-layer valve subassembly 270. FIG. 23B is a side view of the first layer 300. FIG. 23C is a perspective view of the first layer 300. The first layer 300 is a plate containing an air ingress channel 304 (i.e., a groove or slot) that provide a channel for air ingress in the assembled multi-layer valve system 270, when all the layers are stacked on top of one another. The first layer 300 also includes a circular terminus 302, which terminates the air ingress channel 304, and which is aligned with the inflation port 161 on the audio transducer.

Figure 24A:
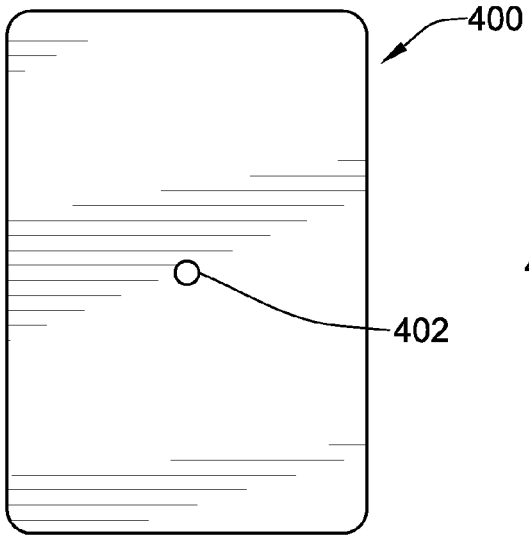
FIG. 24A is a top view of a second layer of the multi-layer valve system.
Figure 24B:
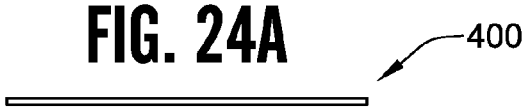
FIG. 24B is a side view of the second layer of the multi-layer valve system.
Figure 24C:
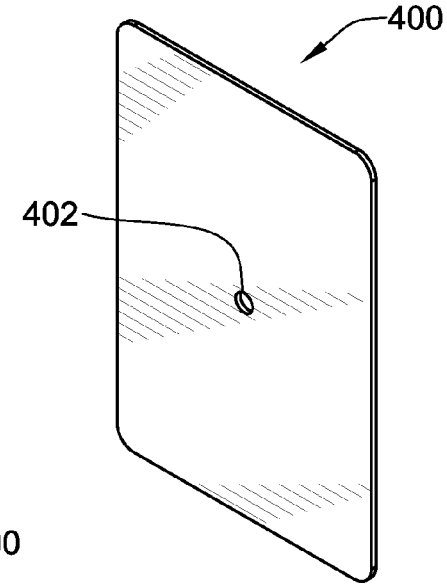
FIG. 24C is an aspect view of the second layer of the multi-layer valve system.

FIG. 24A is a top view of a second layer 400 of the multi-layer valve subassembly 270. FIG. 24B is a side view of the second layer 400. FIG. 24C is a perspective view of the second layer 400. The second layer 400 is a plate with a single small orifice 402 in it. When the multi-layer valve subassembly 270 is assembled, the orifice 402 is aligned with the inflation port (e.g., the inflation port 161) in the transducer case as well as with the circular terminus 302 of the air ingress channel 304 in the first layer 300. The orifice 402 in the second layer 400 is the source of a synthetic jet, which moves air upwardly toward the membrane 220. With reference to FIGS. 21-22, the orifice 402 is smaller than the inflation port 161 in the housing and it is smaller than the circular terminus 302 of the air ingress channel 304 of the first layer 300.

Figure 25A:
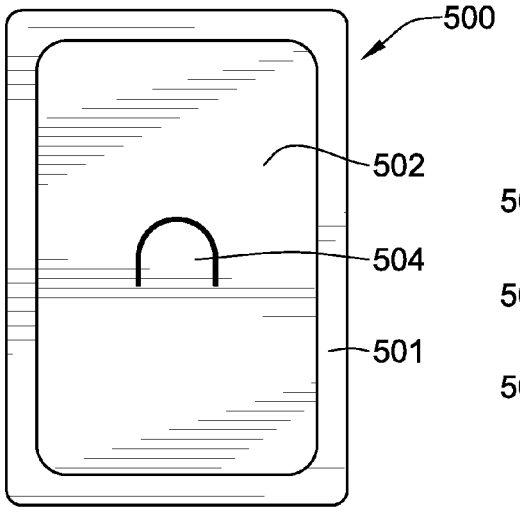
FIG. 25A is a top view of a third layer of the multi-layer valve system.
Figure 25B:
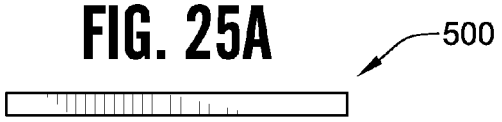
FIG. 25B is a side view of the third layer of the multi-layer valve system.
Figure 25C:
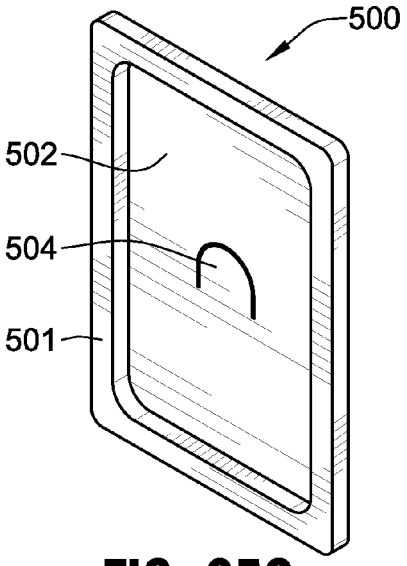
FIG. 25C is an aspect view of the third layer of the multi-layer valve system.

FIG. 25A is a top view of a third layer 500 of the valve subassembly 270. FIG. 25B is a side view of the third layer 500. FIG. 25C is a perspective view of the third layer 500. The third layer 500 is a rigid frame 501 with an open central region. The rigid frame 501 has its central region spanned by a thin, flexible film 502. The film 502 may be composed of polyethylene terephalate (PET). The flexible film 502 can be composed of any other polymer materials suitable for use as membranes in valves for sound generating, or sound activated, transducers. The flexible film 502 can also be a non-polymer film or foil such as a thin metal foil. The flexible film 502 is mounted on the frame 501 so that, in the assembled multi-layer valve subassembly 270, the flexible film 502 rests directly on the top of the plate of the second layer 400. Above the flexible film 502 is a narrow gap, which allows the flexible film 502 space to flex upward. A flap 504 is cut in the center of the flexible film 502 of the third layer 500. The flap 504 can be cut in the shape of a "U" as shown in FIG. 25A. In the assembled multi-layer valve system, the flap 504 can be directly over the synthetic jet orifice 402 in the second layer 400. While the third layer 500 is shown as being multiple components (i.e., the frame 501 and film 502), the third layer 500 can also be made as a unitary piece as well.

Figure 26A:
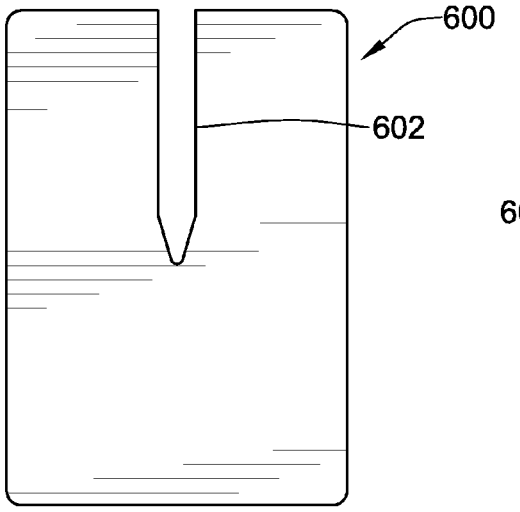
FIG. 26A is a top view of a fourth layer of the multi-layer valve system.
Figure 26B:
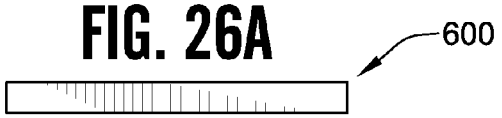
FIG. 26B is a side view of the fourth layer of the multi-layer valve system.
Figure 26C:
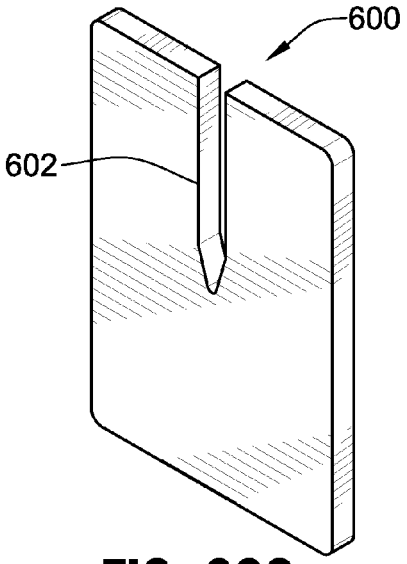
FIG. 26C is an aspect view of the fourth layer of the multi-layer valve system.

FIG. 26A is a top view of a fourth layer 600 of the multi-layer valve subassembly 270. FIG. 26B is a side view of the fourth layer 600. FIG. 26C is an aspect view of the fourth layer 300. The fourth layer 600 is a top plate or cover for the multi-layer valve system. The fourth layer 600 includes an egress channel 602 by which air pumped by the receiver module exits the device valve subassembly 270 and inflates the membrane 220. In the particular implementation shown, the egress channel 602 can be connected to an egress air tube 702 as shown in FIGS. 27A through 27D.

Figure 27B:
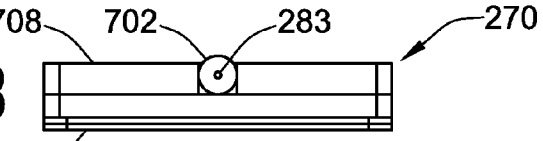
FIG. 27B is a side view of the assembled multi-layer valve system.
Figure 27D:
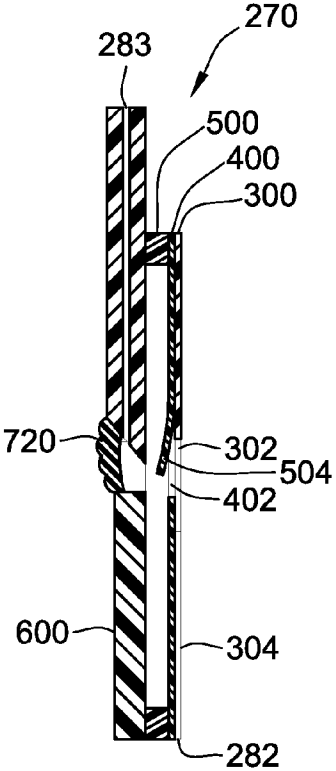
FIG. 27D is a cross-section view of the assembled multi-layer valve system.
Figure 27A:
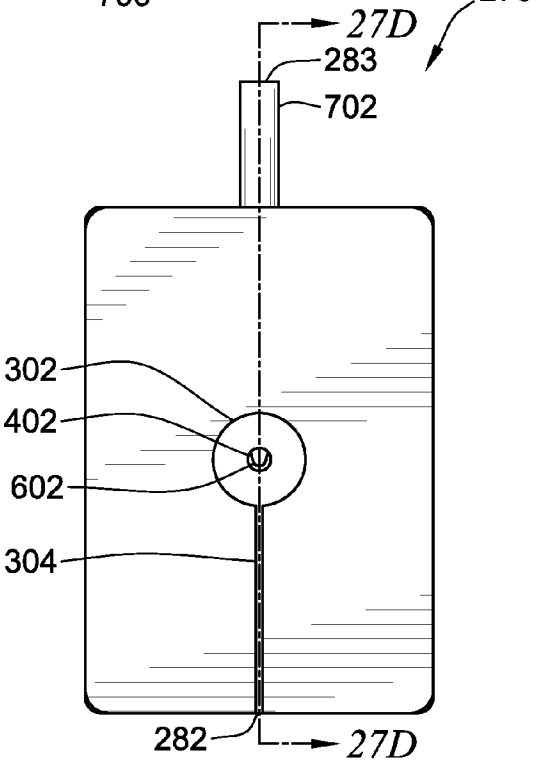
FIG. 27A is a top view of an assembled multi-layer valve system.
Figure 27C:
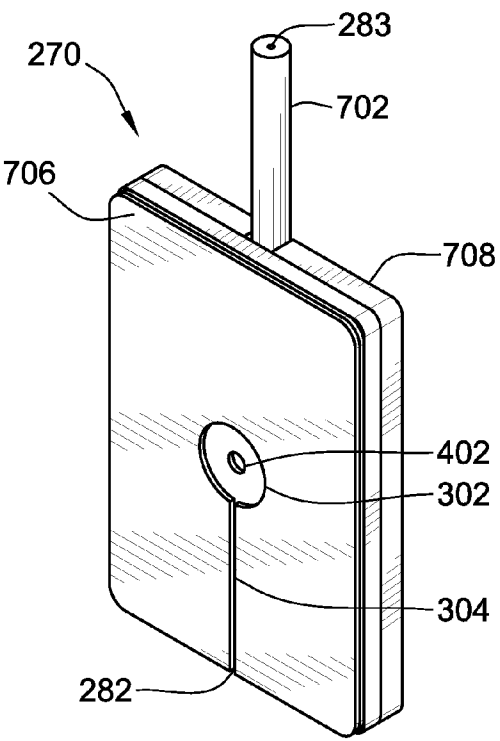
FIG. 27C is an aspect view of the assembled multi-layer valve system.

FIG. 27A is a top view of the assembled multi-layer valve subassembly 270. FIG. 27B is a side view and FIG. 27C is a perspective view of the assembled multi-layer valve subassembly 270. FIG. 27D is a cross-section view of the assembled multi-layer valve subassembly 270. The assembled multi-layer valve subassembly 270 includes the first layer 300, the second layer 400, the third layer 500 (including the film 502), and the fourth layer 600 as well as the egress air tube 702. The air egress tube 702 terminates with the air egress port 283. In an implementation, the air egress port 283 can be connected to the inflatable membrane 220 so as to fluidly couple the inner channel of the air egress tube 702 with an inner volume of the inflatable membrane 220.

When assembled, the assembled multi-layer valve system 270 has a proximal face 706 (here, the surface of the first layer 300) for being attached to an audio transducer, such as the receiver 110, and a distal face 708 (here, the surface of the fourth layer 600) opposite the proximal face 706. The layers in the multi-layer valve system 700 are generally connected so as to provide an air-tight seal between each layer, and between the proximal face 706 and the audio transducer. When assembled, the air ingress channel 304 in the first layer 300 can create a pathway for ambient air to enter the valve system 700 through the tube defined by the surface of the housing of the audio transducer, the air ingress channel 304, and the face of the second layer 400. In such a configuration, the end of the air ingress channel 304 is the air ingress port 282. Ambient air can be drawn through the air ingress port 282, through the ingress air channel 304, to the circular terminus 302. The air is then forced, by, for example, pressure waves generated within an audio transducer (e.g., pressure from the back volume 112 of the receiver 110), to pass through the small orifice 402 in the second layer 400 and past the flap 504 in the flexible film 502 of the third layer 500. The air is then directed into the air egress tube 702, which can be sealed to the fourth layer 600, and the air is directed outward to the air egress port 283. The egress tube 702 can be sealed to the fourth layer 600 using a flexible sealant 720, which can create an air tight seal between the inner volume of air egress tube 702 and the volume defined by the third layer 500. Preferably, the flap 504 at least partially prevents air from passing back through the small orifice 402 so as to maintain a static pressure differential between ambient air in the ingress channel 304 and the air in the air egress tube 702 (and the membrane 220).

An operation of a receiver module 110 having an assembled multi-layer valve system 270 is described in connection with FIG. 27D, which shows the multi-layer valve system 270. In a receiver module 110 where the multi-layer valve system 270, (i.e., the multi-layer valve sub-assembly) is mounted so as to seal the circular terminus 302 of the first layer 300 to the inflation port 161 of the receiver 110. In an exemplary operation of the receiver module 110 thus assembled, ambient air may be drawn in, or introduced, through the air ingress port 282, and through the 304. The air is then forced through the small orifice 402 and past the flap 504. The air can be forced past the flap 504 by pressure carried in acoustic waves emanating from oscillations of the diaphragm 116 within the receiver module 110. As more air is forced into the cavity formed in the third layer 500 internal to the frame 501, the air is then urged into the air egress tube 702 toward the air egress port 283. The air can be prevented from escaping the multi-layer valve system 270 by using a flexible air tight sealant, such as, for example, the flexible sealant 720 applied to the junction between the air egress tube 702 and the fourth layer 600. Alternatively, the air egress tube 702 can be integrally formed with fourth layer 600 or welded, soldered, or otherwise adhered to the fourth layer 600 so as to prevent air from escaping the cavity within the third layer 500 by a path other than through the air egress tube 702, and out the air egress port 283.

Figure 28:
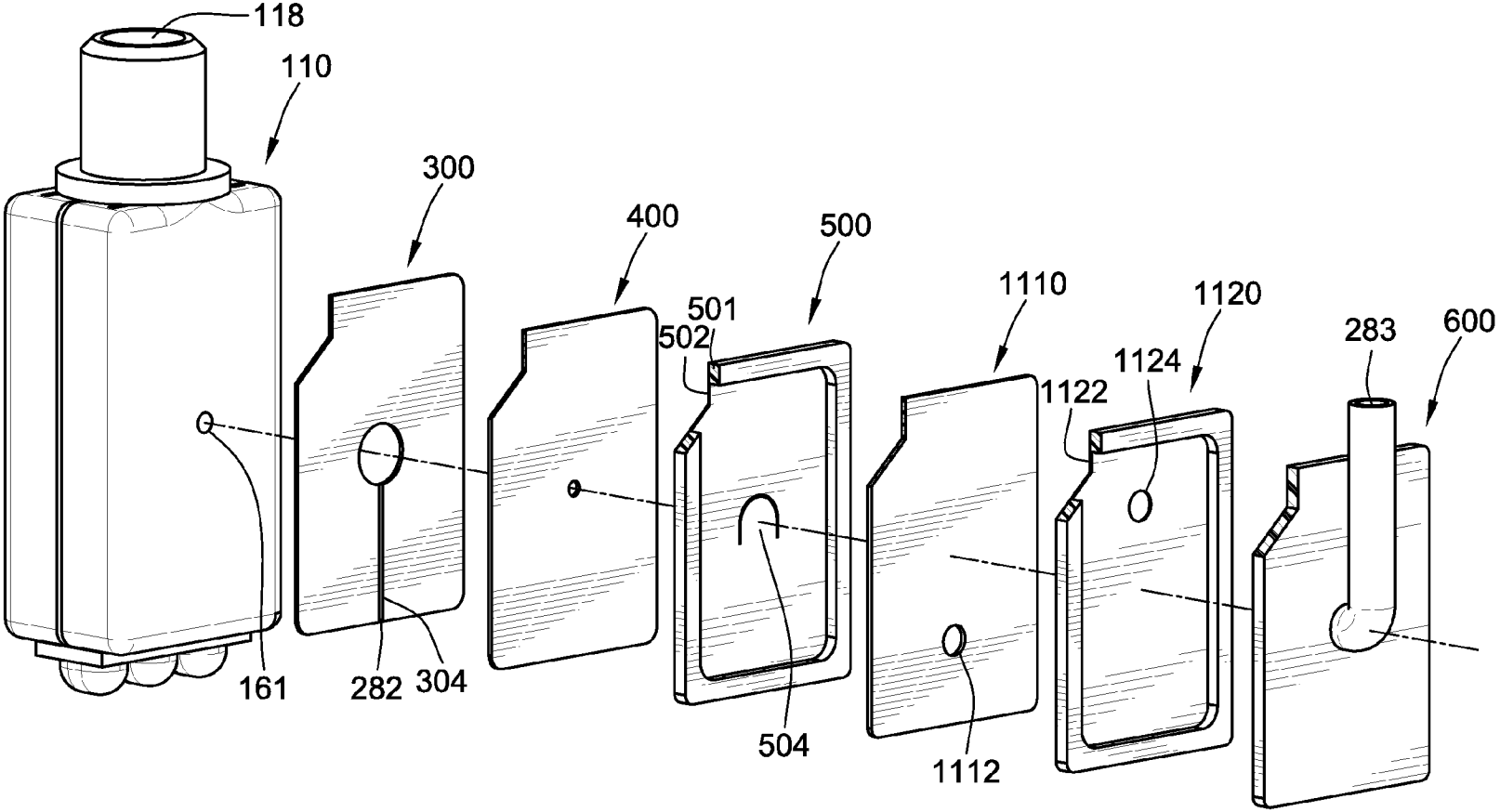
FIG. 28 provides the disassembled layers of a multi-layer valve system for mounting to an audio transducer having six layers and having a check valve.
Figure 29:
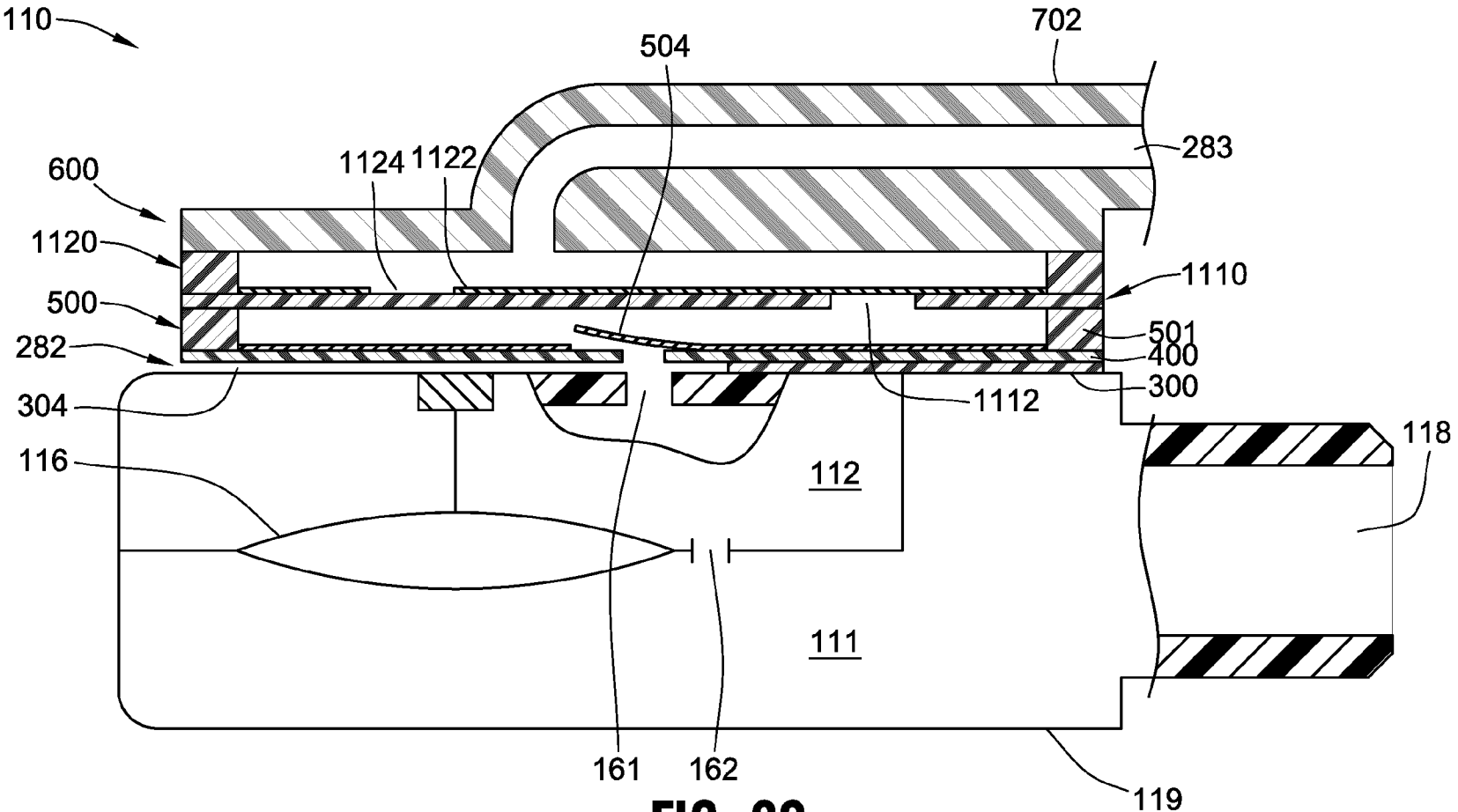
FIG. 29 is a functional block diagram showing the assembled, six layer structure.

Experimentation with prototype devices has shown that it is often desirable to prevent escape of air from an inflatable membrane 220 by leakage back through the valve system 270, during time periods when the valve system 270 is not pumping, but during which the inflatable membrane 220 needs to remain statically inflated. To prevent air leakage back through the valve system 270, the valve system 270 itself can be designed to minimize leakage or a check valve may be added to the valve system 270 by addition of two more layers to the multi-layer valve system sub-assembly as shown in FIGS. 28 and 29. The check valve can prevent back-flow of air by acting as a one-way valve that allows to pass when moving toward the egress port 283, but not in the opposite direction, toward the ingress port 282.

FIG. 28 provides the disassembled layers of a multi-layer valve system having six layers and having a check valve. The first layer 300, second layer 400, and valve layer 500 are the same as shown in connection with the multi-layer valve system 270 shown in FIGS. 27A through 27D. In addition, a check valve is created from a first check valve layer 1110 and a second check valve layer 1120. The first check valve layer 1110 is a plate with a single small hole 1112 in it. The hole 1112 may not be in the center of the plate, but can be closer to one of the ends of the plate, along its long axis. The second check valve layer 1120 is a rigid frame with a flexible film 1122, or membrane, on its lower side, similar to the valve layer 500. However, in the second check valve layer 1120, there is no flap, but rather another small hole in the flexible film 1122, which is located at the opposite end from the hole 1112 in the plate of the first check valve layer 1120. The region of contact of the top of the plate of the first check valve layer 1120 and the bottom of the flexible film 1122, between the hole 1112 and the hole 1124 in the flexible film 1122 provide a sealing function of the check valve. Placing the holes 1112, 1124 at opposite ends of the multi-layer valve system creates the largest possible valve seat for the check valve and thus improves the seal. The top and final layer 600 is the same cover plate shown in connection with FIGS. 27A through 27D and provides an air egress port 283 for air escaping from the valve system.

FIG. 29 is a functional block diagram showing the assembled, six layer structure of FIG. 28. Aspects of the multi-layer valve system are illustrated functionally, but are not necessarily illustrated to scale, or order to show additional details of the six layer structure. In an exemplary operation of the multi-layer valve system shown in FIG. 29, ambient air enters through the air ingress port 282 and is then forced, by acoustic waves generated within the back volume 112 of the audio transducer to push past the flap 504 in the flexible film 502. As more air accumulates in the small cavity, or chamber, within the third layer 500, pressure builds and the air pushes through the check valve by entering the hole 1112 and pushing past the seal created by the contact between the flexible film 1122 and the plate of the first check valve layer 1110. When sufficient pressure is achieved, the air pushes through the hole 1124 in the flexible film 1122 and is urged through the air egress tube 702 where it emerges through the air egress port 283. By preventing air from moving back through the seal, the check valve acts as a one-way valve allowing air to move in one direction, but not the other. The air emerging from the air egress port 283 can be directed into the interior volume of the inflatable membrane 220 and thereby inflate the inflatable membrane 220.

Because the inflatable membrane 220 is not rigid, the inflatable membrane 220 and the receiver module 110 can be comfortably removed from the ear canal, even when inflated. Alternatively, or in addition, the receiver module 110 may be further configured with a deflation valve subassembly for deflating the inflatable membrane 220. Deflating the inflatable membrane 220 may facilitate the removal of the receiver module 110 from the ear canal. In addition, the deflation valve subassembly can be remote-controlled such that, for example, a certain unique signal input to the receiver causes a movement of the deflation valve to release the pressure within the inflated membrane 220. Or, the deflation valve can be manually actuated outside of the ear once the user has removed the membrane 220 from his or her ear while in the inflated state.

Implementations of the multi-layer valve system 270 illustrated in FIGS. 27A through 29 can have an overall width, when assembled, less than the width of the housing 119 of the audio transducer the multi-layer valve system 270 is configured to be mounted to. In this way, the multi-layer valve system 270 is configured to be a flat valve system that maintains a low profile against the particular audio transducer selected and allows the entire receiver module 110, thus assembled, to be inserted into a user's ear canal. Additionally, the overall thickness of the multi-layer valve system 270 can be less than the width dimension of the housing of a selected audio transducer. For example, in an implementation of the present disclosure where the receiver module 110 incorporates a Sonion 44A030 model transducer, the multi-layer valve system 270 can have a width and length less than the width and length of the 44A030.

Implementations of the multi-layer valve system 270 shown in FIGS. 23A through 29 can include parts machined from stainless steel as well as layers of plastic film that are bonded to some of the stainless steel layers. For the purpose of producing diaphonic valves in large numbers at a reduced cost, it is desirable to have an manufacture the multi-layer valve system 270 from parts that are easily and rapidly fabricated and assembled.

The layers in the multi-layer valve system 270 can be made out of a wide range of materials such as steel, stainless steel, aluminum, other metals, polyethylene terephthalate (PET), polyether ketone (PEK), polyether etherketone (PEEK), polyamide (nylon), polyester, polyethylene, high density polyethylene, polytetrafluroethylene (PTFE), expanded polytetrafluorothylene (ePTFE), fluoropolymer, polycarbonate, acrylonitrile butadiene styrene (ABS), polybutylene terephthalate (PBT), polyphenylene oxide (PPO), polysulphone (PSU), polyimides, polyphenylene sulfide (PPS), polystyrene (PS), high impact polystyrene (HIPS), polyvinyl chloride (PVC), polypropylene (PP), polyolefins, plastics, engineering plastics, thermoplastics, thermoplastic elastomers, Kratons®, copolymers, or block copolymers. The layers can also be composed of blends or composites of these materials or versions of these materials to which have been added fillers, modifiers, colorants, and the like. Different layers of the structures may be composed of the same material or of different materials.

As an example, the multi-layer valve system 270 shown in FIG. 28 may be made out of PET plastic. The characteristics of the multi-layer valve system shown in FIG. 28 can be as follows. The first layer 300 may be made of PET, and the overall dimensions can be 0.04 mm high by 2.5 mm wide by 5.0 mm long, and the circular terminus 302 may have a diameter of 0.25 mm. The air ingress channel 304 may have a width of 0.06 mm or of 0.1 mm. The overall dimensions of the first layer 300 may also be 0.04 mm high by 2.25 mm wide by 3.27 mm long. The second layer 400 may be made of PET, and the overall dimensions can be 0.04 mm high by 2.5 mm wide by 5.0 mm long. The orifice 402 in the second layer 400 may have a diameter of 0.14 mm or of 0.15 mm. The frame 501 of the valve layer 500 may made of PET and can have overall dimensions of 0.04 mm high by 2.5 mm wide by 5.0 mm long. The overall dimensions of the valve layer 500' may also be 0.15 mm high by 2.25 mm wide by 3.27 mm long. The flap 504 in the flexible film 502 may have a characteristic dimension of 0.2 mm. The first check valve layer 1110 may be made of PET and have overall dimensions of 0.04 mm high by 2.5 mm wide by 5.0 mm long or may also have overall dimensions of 0.04 mm high by 2.25 mm wide by 3.27 mm long. The second check valve layer 1120 can be made of PET and may have overall dimensions of 0.04 mm high by 2.5 mm wide by 5.0 mm long or may also have overall dimensions of 0.04 mm high by 2.25 mm wide by 3.27 mm long. The fourth layer 600 (or cover layer) can be made of PET and can have overall dimensions of 0.04 mm high by 2.5 mm wide by 5.0 mm long or may also have overall dimensions of 0.2 mm high by 2.25 mm wide by 3.27 mm long. The egress tube 702 can have an inner diameter of 0.3 mm and can be affixed to a 0.3 mm by 0.3 mm tubing port. In addition, the inflation port 161 in the receiver module 110 can have a diameter of 0.25 mm.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. A receiver module comprising:

a housing having a sound port for transmitting acoustic waves within an ear canal and an inflation port;

a diaphragm within the housing, the diaphragm being driven to create: (i) the acoustic waves in response to a first electrical input signal to the receiver module, and (ii) a membrane-inflation pressure adjacent to the inflation port in response to a second electrical input signal to the receiver module;

a front volume on one side of the diaphragm within the housing and in direct communication with the sound port, the front volume allowing the acoustic waves to be transmitted through the sound port;

a back volume within the housing on an opposing side of the diaphragm relative to the front volume, the back volume being in direct communication with the inflation port; and a valve system coupled to the housing directly adjacent to the inflation port, the valve system including a plurality of layers to provide a flat configuration to the valve system wherein the flat configuration to the valve system has a thickness that is less than the width dimension of the housing, at least one of the plurality of layers defining an egress port, and wherein in response to the membrane-inflation pressure created by the diaphragm, the valve system expelling air through the egress port to inflate an external inflatable membrane located within the ear canal of a user.

2. The receiver module of claim 1, wherein the valve system further includes an ingress port for supplying ambient air that is passed to the egress port.

3. The receiver module of claim 1, wherein a first one of the plurality of layers in the valve system is a flexible polymeric layer, the flexible polymeric layer including a cut that defines a valve flap.

4. The receiver module of claim 3, wherein the valve flap has a U-shape.

5. The receiver module of claim 3, wherein the valve flap is located directly above the inflation port on the housing.

6. The receiver module of claim 3, wherein the flexible polymeric layer is polyethylene terephthalate (PET).

7. The receiver module of claim 3, wherein another one of the plurality of layers in the valve system includes a check valve.

8. The receiver module of claim 1, wherein the housing at least partially defines an air-ingress channel between the inflation port and an ambient air source.

9. The receiver module of claim 8, wherein the housing and one of the plurality layers define the air-ingress channel.

10. The receiver module of claim 1, wherein the back volume and the front volume are connected by a compensation port.

11. A method of operating a receiver module positioned within an ear canal of a user to generate a static pressure differential, the receiver module including a valve system that includes a plurality of layers mechanically coupled to a housing of the receiver, the valve system having a flat profile with an overall thickness that is less than the width dimension of the housing, the plurality of layers of the valve system having an egress port being coupled to the inflatable membrane, the method comprising:

drawing air in through an ingress port defined by at least one of the plurality of layers of the valve system of the receiver module;

generating, by use of a diaphragm, pressure within a back volume of the receiver module; and forcing air displaced by the generated pressure into the valve system and expelling the displaced air through the egress port, the plurality of layers of the valve system being configured to substantially maintain a static pressure differential between the back volume and the egress port so as to optimize the receiver module for inflating an inflatable membrane located within the ear canal.

12. The method of operating the receiver module of claim 11, wherein the plurality of layers of the valve system includes a flexible polymeric material having a valve flap.

13. The method of operating the receiver module of claim 11, further comprising inhibiting a flow of air back from the egress port into the back volume of the receiver module.

14. The method of operating the receiver module of claim 13, wherein the inhibiting occurs through use of a one-way valve to substantially prevent air from passing back from the egress port.

15. The method of operating the receiver module of claim 14, wherein the preventing is carried out with a check valve defined by one or two of the layers within the valve system.

16. The method of operating the receiver module of claim 11, further comprising generating an acoustic signal with the diaphragm in response to first electrical input signals corresponding to ambient sound received by a microphone, and transmitting the acoustic signals through a sound port of the receiver module toward a tympanic membrane within the ear canal.

17. The method of operating the receiver module of claim 16, wherein the generated pressure corresponds to second electrical input signals received by the receiver module.

18. The method of operating the receiver module of claim 11, wherein the housing of the receiver module includes an inflation port that transmits the generated pressure into the valve system.

19. The method of operating the receiver module of claim 18, wherein the inflation port leads into a larger air-ingress region coupled to the ingress port, the air-ingress region leading to a valve flap defined by a polymeric film associated with one of the plurality of layers.

* * * * *